US007490923B2

(12) United States Patent
Shibuya et al.

(10) Patent No.: US 7,490,923 B2
(45) Date of Patent: Feb. 17, 2009

(54) LIQUID EJECTING HEAD

(75) Inventors: Hirokazu Shibuya, Yamagata-ken (JP); Yasunori Koike, Nagano-ken (JP); Noriaki Okazawa, Nagano-ken (JP); Katsuhiro Okubo, Nagano-ken (JP); Gaku Ko, Nagano-ken (JP); Tatsuo Akatsu, Nagano-ken (JP); Takateru Yamashita, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 387 days.

(21) Appl. No.: 11/312,456

(22) Filed: Dec. 21, 2005

(65) Prior Publication Data

US 2006/0164467 A1 Jul. 27, 2006

(30) Foreign Application Priority Data

Dec. 21, 2004 (JP) ..... P2004-369660
Mar. 4, 2005 (JP) ..... P2005-060044
Mar. 18, 2005 (JP) ..... P2005-079345

(51) Int. Cl.
*B41J 2/14* (2006.01)

(52) U.S. Cl. ..... 347/47

(58) Field of Classification Search ..... 347/45, 347/47, 70

See application file for complete search history.

(56) References Cited

U.S. PATENT DOCUMENTS 5,956,058 A * 9/1999 Momose et al. ..... 347/71
6,036,105 A * 3/2000 Sanada et al. ..... 239/104
6,048,053 A * 4/2000 Kamoi et al. ..... 347/70
6,296,351 B1 * 10/2001 Tanaka et al. ..... 347/68

FOREIGN PATENT DOCUMENTS

| | | | |
|---|---|---|---|
| JP | 5-201000 | A | 8/1993 |
| JP | 10-16240 | A | 1/1998 |
| JP | 11-207979 | A | 8/1999 |
| JP | 11-291465 | A | 10/1999 |
| JP | 2000-190513 | A | 7/2000 |
| JP | 2004-74676 | A | 3/2004 |
| JP | 2004-351923 | A | 12/2004 |
| WO | WO 99/15337 | A1 | 4/1999 |

* cited by examiner

*Primary Examiner*—An H Do
(74) *Attorney, Agent, or Firm*—Sughrue Mion, PLLC

(57) ABSTRACT

A conductive nozzle plate is formed with a nozzle orifice. An insulative layer is formed on a first face of the nozzle plate. A head body includes a pressure chamber adapted to contain liquid therein and a pressure generating element operable to cause pressure fluctuation in the liquid. The head body is attached to a second face of the nozzle plate so as to communicate the pressure chamber with the nozzle orifice. The second face of the nozzle plate and the head body are fixed to a head case. A conductive head cover covers a part of the first face of the nozzle plate while exposing the nozzle orifice. A part of the nozzle plate and the head cover directly come into contact with each other.

15 Claims, 22 Drawing Sheets

LIQUID EJECTING HEAD

BACKGROUND OF THE INVENTION

The present invention relates to a liquid ejecting head, such as an ink jet type recording head, and more particularly, to a liquid ejecting head which is provided with a nozzle forming member having a plurality of nozzle orifices formed thereon and which can eject liquid from the nozzle orifices in forms of liquid droplets. The present invention also relates to a method of manufacturing such a liquid ejecting head.

As a liquid ejecting head which causes a pressure change of liquid within a pressure chamber so as to eject liquid droplets from the nozzle orifices, for example, an ink jet type recording head which is used in an image recording apparatus, such as a printer or the like, a color material ejecting head which is used for manufacturing a color filter of a liquid crystal display or the like, an electrode material ejecting head which is used for forming electrodes of an organic electroluminescent (EL) display, a field emission display (FED), or the like, a biological organic material ejecting head which is used for manufacturing a bio chip (biochemical element), and the like can be used.

Of various types of liquid ejecting heads, for example, an ink jet type recording head (hereinafter, referred to as recording head) in an ink jet type recording apparatus (hereinafter, simply referred to as printer) is provided with a head unit (head main body) having a flow passage unit, in which a liquid flow passage from a reservoir to nozzle orifices through a pressure chamber is formed, or an actuator unit having a pressure generating element which can change a volume of the pressure chamber, a metallic nozzle plate having nozzle lines, in which a plurality of nozzle orifices are provided to be connected with the liquid flow passage, and a head case, made of resin, to which the head unit and the nozzle plate (a type of nozzle forming member) are fixed.

In such a recording head, flight deviation may occur in liquid droplets to be ejected according to a state around the nozzle orifice, that is, a state in which liquid, such as ink or the like, wets around the nozzle orifice. That is, if liquid, such as ink or the like, wets around the nozzle orifice, liquid droplets are pulled by a surface tension of that part at the time of eject, which causes flight deviation. In general, in order to prevent flight deviation, a liquid repellent treatment for preventing adhesion of liquid, such as ink or the like, around the nozzle orifice is performed on a liquid ejecting surface of the nozzle plate.

The nozzle plate in the recording head is fixed to the head case by the metallic head cover having an exposure window, through which the nozzle orifices of the nozzle plate are exposed. The head cover has a function of protecting the head unit or the nozzle plate and preventing the individual parts from being separated. In addition, the head cover, which is set to a ground potential, comes into contact with the nozzle plate to be electrically connected thereto, thereby removing static electricity generated in recording paper or the like from the nozzle plate. Accordingly, for example, an inconsistency, such as an electrostatic breakdown of a driving circuit or the like caused by static electricity to be transferred through the nozzle plate, or an inconsistency, or an erroneous operation caused by the superimposition of the static electricity on a driving signal as noise can be prevented. Such a configuration is disclosed in, for example, Japanese Patent Publication Nos. 2004-74676A and 2000-190513A.

Recently, however, in such a printer, there is a tendency that pigment-based ink for improving image quality or water-resistant ink for improving water resistance is used. As a solvent of such ink, instead of water, a resin-based dispersing agent is used. For this reason, a liquid repellent coating layer, which is formed on the liquid ejecting surface of the nozzle plate so as to prevent defective eject, such as flight deviation caused by ink adhesion around the nozzle orifice, needs to have high liquid repellency according to such ink. Further, in order to reduce manufacturing costs by simplifying a coating treatment process, in addition to the significant improvement of liquid repellency or quality, the liquid repellent treatment is performed on the liquid ejecting surface of the nozzle plate, for example, using a thin film deposition technology. With the liquid repellent treatment, a liquid repellent coating layer, which contains more fluorine resin is formed on the liquid ejecting surface of the nozzle plate. However, if the content ratio of fluorine resin is increased in order to enhance liquid repellency, an insulation property of the liquid ejecting surface of the nozzle plate is increased accordingly, since fluorine resin has a high insulation property.

On the other hand, as the water repellent film with an improved water repellent performance, the use of a glassy insulating film has been examined, as described in Japanese Patent Publication No. 2004-351923A.

If such a liquid repellent coating layer or an insulating film is formed on the nozzle surface of the nozzle plate, the nozzle plate and the head cover face each other through the insulating film when the head cover is simply mounted as described the above, and thus the static electricity flying from the paper to the nozzle plate or the charges of the nozzle plate cannot be released through the head cover.

SUMMARY OF THE INVENTION

It is therefore an object of the present invention to provide a liquid ejecting head which can ensure an electrical connection between a nozzle forming member and a head cover, even when liquid repellency of a liquid ejecting surface of the nozzle forming member is improved.

In order to achieve the above object, according to the invention, there is provided a liquid ejection head, comprising:

a conductive nozzle plate, formed with a nozzle orifice;

an insulative layer, formed on a first face of the nozzle plate;

a head body, including a pressure chamber adapted to contain liquid therein and a pressure generating element operable to cause pressure fluctuation in the liquid, the head body attached to a second face of the nozzle plate so as to communicate the pressure chamber with the nozzle orifice;

a head case, to which the second face of the nozzle plate and the head body are fixed; and a conductive head cover, covering a part of the first face of the nozzle plate while exposing the nozzle orifice, wherein a part of the nozzle plate and the head cover directly come into contact with each other.

A projection may be formed on the head cover so as to come in contact with the nozzle plate through the insulative layer.

The head cover may include a frame portion covering the part of the first face of the nozzle plate and a window portion exposing the nozzle orifice. The projection may be formed on an inner peripheral edge of the window portion.

The head cover may include a through hole adapted to receive a pin member for fixing the head cover to the head case. The projection may be formed on an inner peripheral edge of the through hole.

A projection may be formed on the first face of the nozzle plate. The insulative layer may be removed from a top face of the projection so that the top face of the projection comes in contact with the head cover.

A height dimension of the projection may be greater than a thickness dimension of the insulative layer.

A recess may be formed on the second face of the nozzle plate so as to oppose the projection.

A recess may be formed on the first face of the nozzle plate, and the projection may be formed around the recess.

The projection may be formed in the vicinity of an edge of the nozzle plate.

The head cover may include a fixing portion adapted to receive a screw member for fixing the head cover to the head case. The projection may be formed in the vicinity of the fixing portion.

The head cover may include a fixing portion adapted to receive a screw member for fixing the head cover to the head case. The projection may be formed in a region receiving a torque generated when the screw member is screwed.

A position of the projection may indicate a position in a mother conductive plate from which the nozzle plate is cut out.

The insulative layer may include a liquid repellent coating.

The nozzle plate may be grounded via the head cover.

According to the invention, there is also provided a method of manufacturing a liquid ejecting head, comprising:

providing a conductive nozzle plate formed with a nozzle orifice;

forming an insulative layer on a first face of the nozzle plate;

attaching a head body including a pressure chamber adapted to contain liquid therein and a pressure generating element operable to cause pressure fluctuation in the liquid, to a second face of the nozzle plate so as to communicate the pressure chamber with the nozzle orifice;

fixing the second face of the nozzle plate and the head body to a head case;

covering a part of the first face of the nozzle plate with a conductive head cover, while exposing the nozzle orifice; and bringing a part of the nozzle plate and the head cover into direct contact with each other.

The manufacturing method may further comprise: forming a projection on the head cover; and bringing the projection into contact with the nozzle plate through the insulative layer.

The manufacturing method may further comprise: forming a projection on the first face of the nozzle plate; removing the insulative layer from a top face of the projection; and bringing the top face of the projection into contact with the head cover.

The manufacturing method may further comprise forming a recess on the second face with laser marking, thereby forming the projection.

The manufacturing method may further comprise forming a recess on the second face with press working, thereby forming the projection.

The manufacturing method may further comprise forming a recess on the first face with laser marking, thereby forming the projection.

The manufacturing method may further comprise: providing a mother conductive plate adapted such that a plurality of nozzle plates are cut out therefrom; and forming the projection on each of the nozzle plates such that a position of the projection indicates a position of each nozzle plate in the mother conductive plate.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Embodiments of the present invention will be described below in detail with reference to the accompanying drawings. In the following description, an ink jet type recording apparatus (hereinafter, simply referred to as printer), which is a representative liquid ejecting apparatus, will be exemplified.

Figure 1:
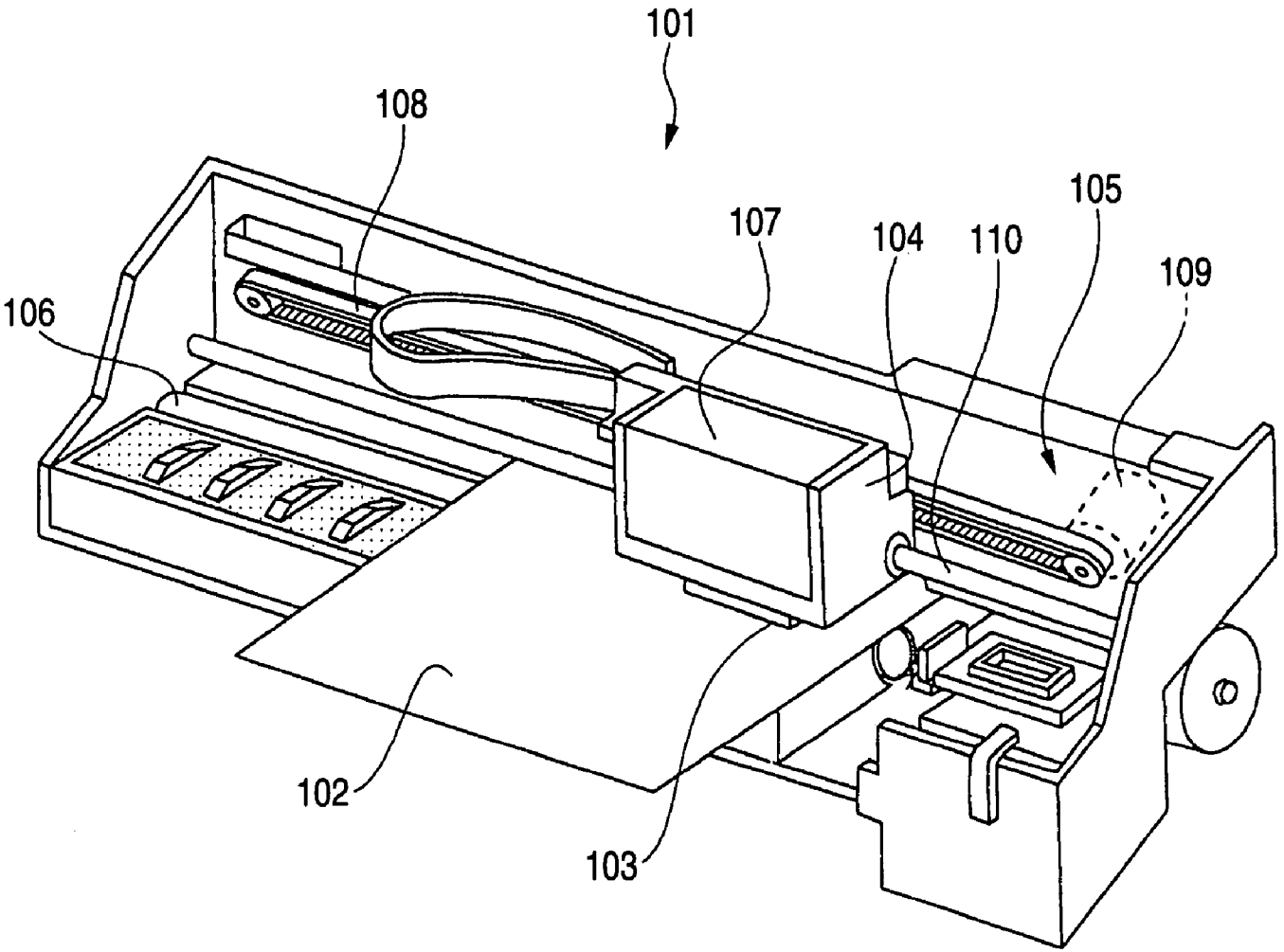
FIG. 1 is a perspective view of an ink jet printer incorporating an ink jet recording head according to a first embodiment of the invention.

As shown in FIG. 1, a printer 101 according to the first embodiment is an apparatus which ejects liquid ink onto the surface of a recording medium 102, such as recording paper or the like, so as to record images or the like. The printer 101 is provided with an ink jet type recording head 103 (hereinafter, is referred to as recording head) which ejects ink, a carriage 104 on which the recording head 103 is mounted, a carriage moving mechanism 105 which moves the carriage 104 in a primary scanning direction, and a platen roller 106 which transfers the recording medium 102 in a secondary scanning direction. Here, ink, which is a type of liquid of the present invention, is stored in an ink cartridge 107. The ink cartridge 107 can be detachably mounted with respect to the recording head 103.

The carriage moving mechanism 105 is provided with a timing belt 108, which is driven by a pulse motor 109, such as a direct-current (DC) motor. Therefore, if the pulse motor 109 operates, the carriage 104 is guided to a guide rod 110 erected in the printer 101 so as to reciprocate in the primary scanning direction (a widthwise direction of the recording medium 102).

Figure 2:
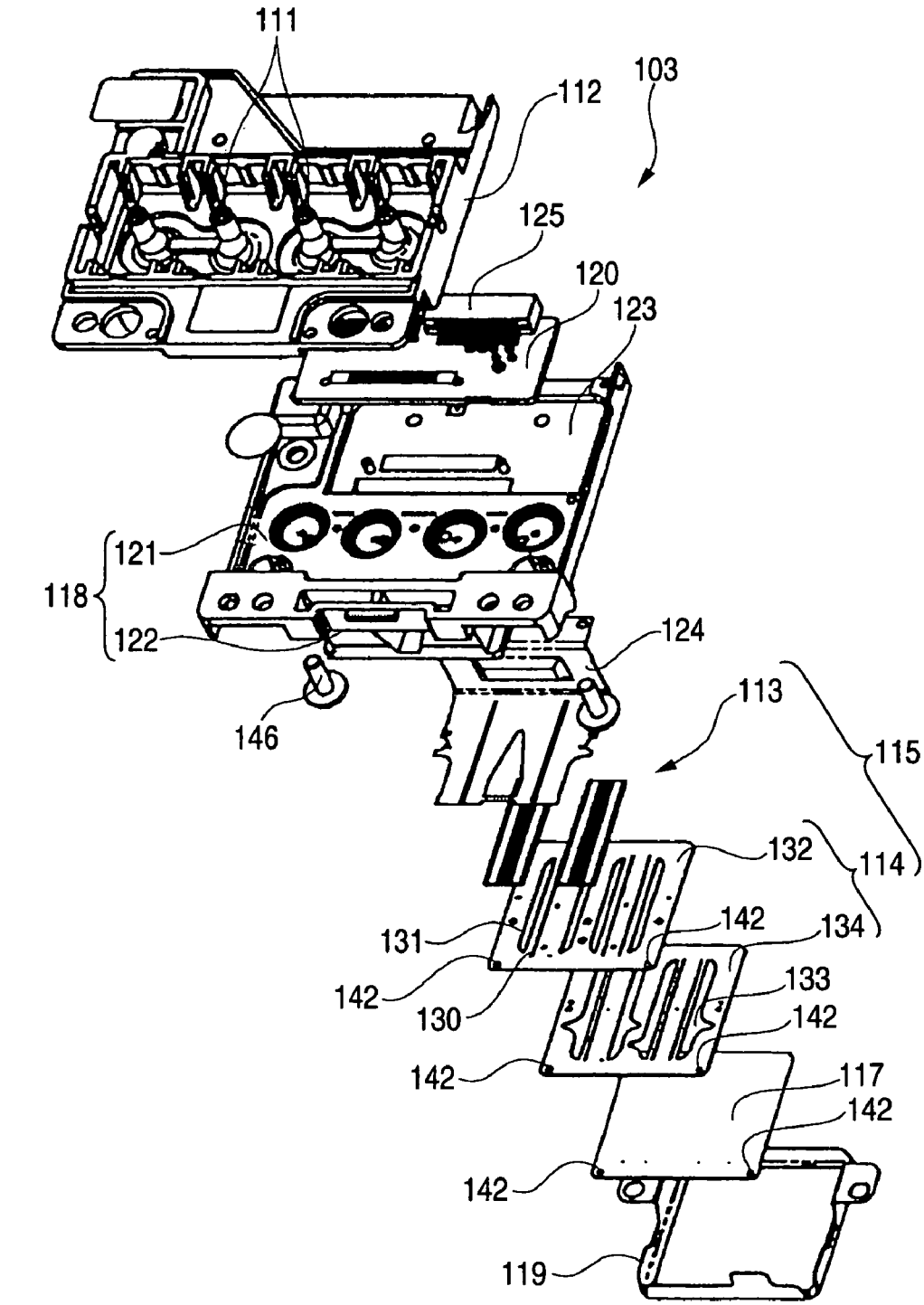
FIG. 2 is a perspective view showing a disassembled state of the ink jet recording head, viewed from an upper side thereof.
Figure 3:
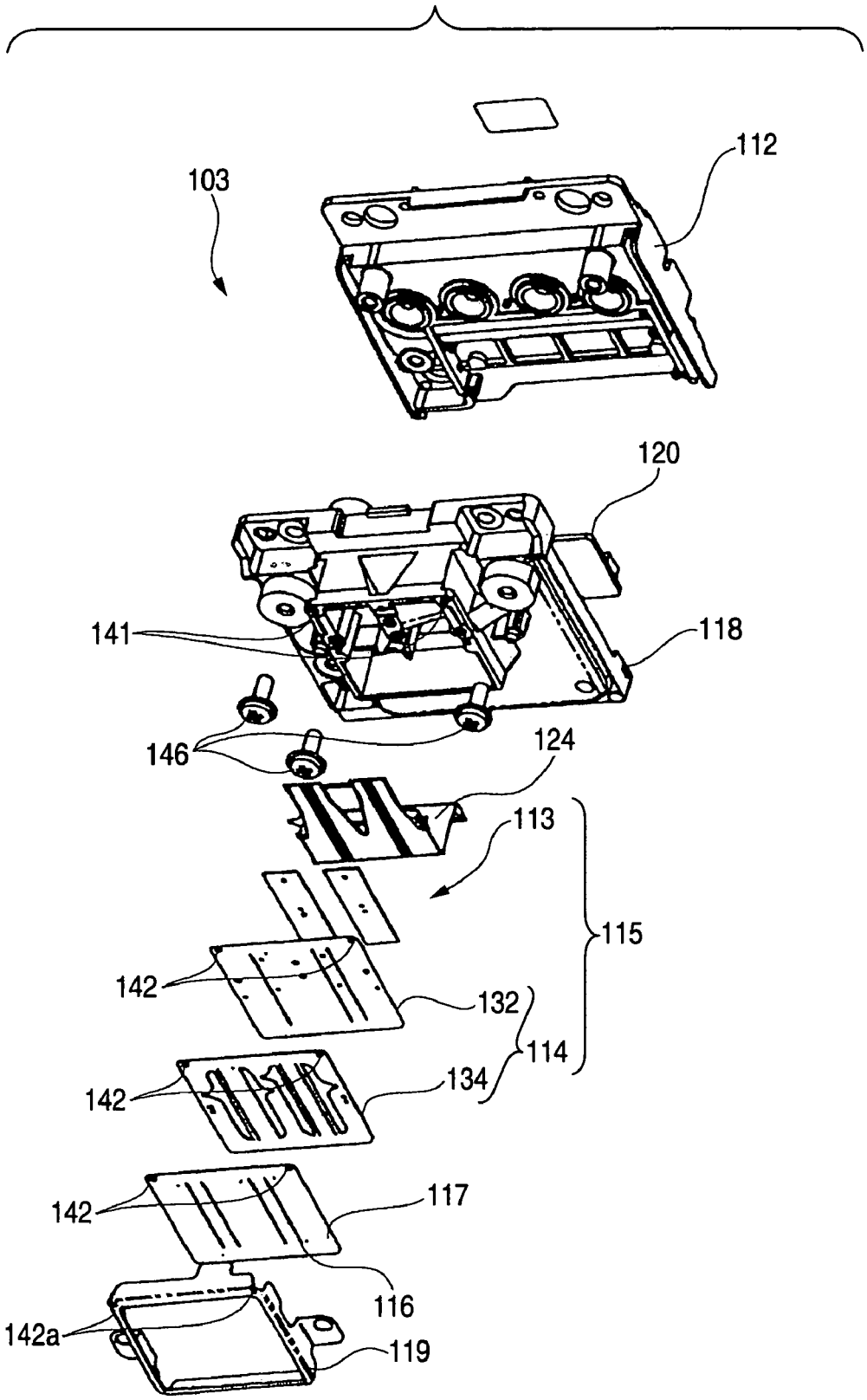
FIG. 3 is a perspective view showing the disassembled state of the ink jet recording head, viewed from a lower side thereof.

As shown in FIGS. 2 and 3, the recording head 103 comprises, in a head case 118, a supply needle unit 112 in which a plurality of ink supply needles 111 for introducing ink within the ink cartridge 107 into the head 103 are provided, a head unit 115 having head constituting members, such as an actuator unit 113, a flow passage unit 114, and the like, and a nozzle plate 117 having nozzle arrays 116 in which a plurality of nozzle orifices are provided. Further, in the recording head 103, a head cover 119 is mounted on the front end of the head case 118 so as to protect side portions of the head unit 115 or the nozzle plate 117 and to adjust the nozzle plate 117 to have a ground potential.

The head case 118 is a member having a base section 121 on which the supply needle unit 112 and a wiring board 120 are mounted, and a hollow box-shaped case section 122 which extends downward from the bottom portion of the base section 121 and in which the head unit 115 is mounted on an opened face thereof. The head case 118 and the ink supply needle unit 112 are formed of, for example, epoxy-based synthetic resin or the like.

In the base section 121 of the head case 18, a substrate disposing section 123 in which the wiring board 120 is disposed is partitioned. The wiring board 120 is a board on which electronic components for various driving signals are mounted and connection terminals are formed to be connected to terminals at one end of a flexible cable 124 of the actuator unit 113. In addition, the wiring board 120 includes a connector 125 to which control cables, such as flexible flat cables (FFCs) or the like, are electrically connected, though not shown.

The head unit 115 has the actuator unit 113 and the flow passage unit 114, which overlap each other to be unitized. The actuator unit 113 has a laminated body of a pressure chamber plate having a pressure chamber formed to correspond to the nozzle orifice, a connection port plate having a connection port formed therein, and a vibration plate on which a piezoelectric vibrator is mounted. Further, the actuator unit 113 has the flexible cable 124, such as a tape carrier package (TCP) or the like, a terminal at the other end of which is electrically connected to the terminal section of the piezoelectric vibrator. The piezoelectric vibrator in the actuator unit 113 is a piezoelectric vibrator in a so-called deflection vibration mode. If the piezoelectric vibrator is driven, that is, deflection-vibrated, the volume of the pressure chamber changes, such that an ink droplet (liquid droplet) is ejected from the nozzle orifice.

The flow passage unit 114 has a supply port plate 132 in which an ink supply port 130 and a compliance section 131 for relaxing the pressure change of a reservoir are formed, and a reservoir plate 134 in which a plurality of reservoirs 133 supplied with ink introduced from the ink cartridge are formed. The supply port plate 132 and the reservoir plate 134 are laminated and bonded to each other by a thermal welding film or the like, thereby forming an ink flow passage from the reservoir 133 to the nozzle orifice. Further, a surface of the reservoir plate 134 opposite to the bonded surface to the supply port plate 132, that is, the bottom surface of the head unit 115 is bonded to the nozzle plate 117.

As the nozzle plate 117, a large material substrate made of, for example, stainless steel having conductivity is used. After nozzle orifices are formed in the material substrate and one surface to be a liquid ejecting surface is subjected to a liquid repellent treatment, the plurality of nozzle plates 117 are cut out from the material substrate. Therefore, a liquid repellent coating layer 135 is formed only on the liquid ejecting surface of the nozzle plate 117.

Moreover, as the nozzle forming member in the present embodiment, the nozzle plate 117, which is formed of a metal substrate, such as stainless steel, is exemplified but is not limited thereto. For example, other materials may be used, as long as at least the liquid ejecting surface is formed of a metallic base material having conductivity.

The liquid repellent coating layer 135 containing fluorine resin is coated on the liquid ejecting surface of the nozzle plate 117 by a thin film deposition technology. Accordingly, in addition to the improvement of liquid repellency and durability, manufacturing costs can be reduced by simplifying a liquid repellent coating process.

In the supply port plate 132 and the reservoir plate 134 of the flow passage unit 114, the nozzle plate 117, and a frame section 140 of the head cover 119, which is mounted to overlap the nozzle plate 117, two positioning holes 142 open at positions corresponding to positioning pins 141. The positioning pins 141 can be correspondingly inserted into the positioning holes 142 so as to position the supply port plate 132, the reservoir plate 134, the nozzle plate 117, and the frame section 140 in the head case 118. When the positioning pins 141 are correspondingly inserted into the positioning holes 142, the head unit 115 and the nozzle plate 117 are relatively positioned, and are fixed to the head case 118 in a state in which the nozzle plate 117 is on the lower side. Further, after the positioning pins 141 are inserted for positioning, the head cover 119 is mounted on the front end of the head case 118 so as to surround the head unit 115 and the nozzle plate 117 from the outside.

Figure 4A:
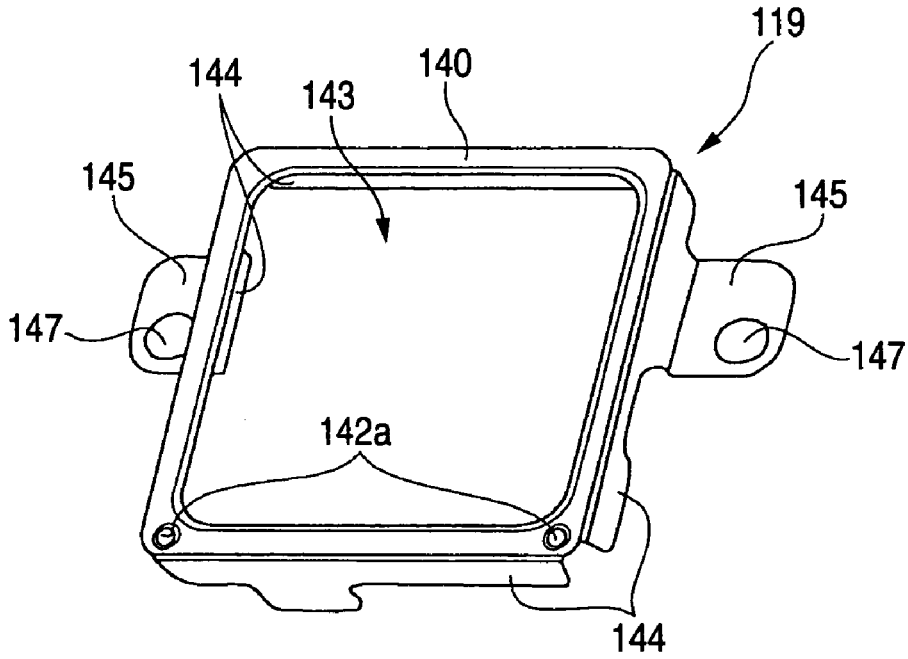
FIG. 4A is a perspective view of a head cover in the ink jet recording head, viewed from a top side thereof.
Figure 4B:
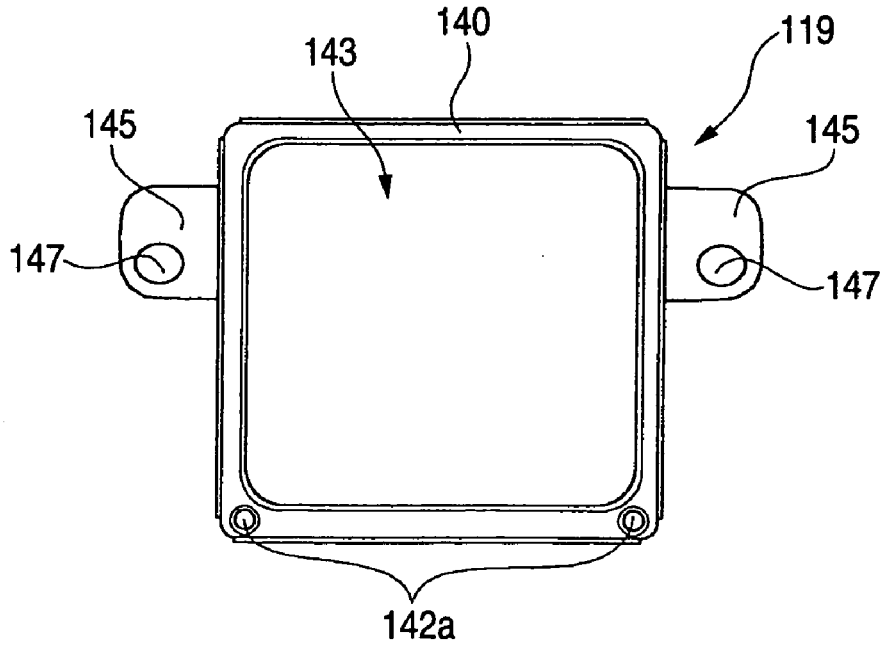
FIG. 4B is a bottom plan view of the head cover of FIG. 4A
Figure 5:
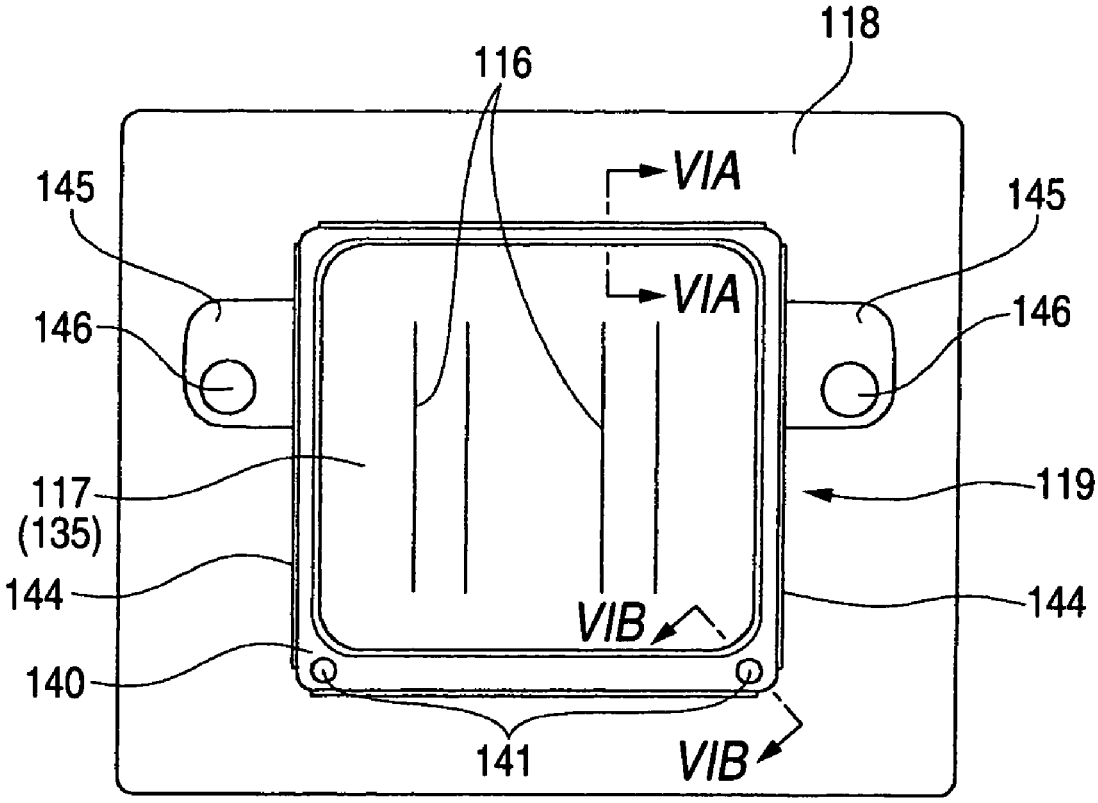
FIG. 5 is a plan view showing a state that the head cover is attached to a head case of the ink jet recording head.

Next, the head cover 119 will be described. As shown in FIGS. 4A and 4B, the head cover 119, which is formed of a metallic plate, such as stainless steel or the like having conductivity, like the nozzle plate 117, schematically has the frame section 140 in which an exposure window 143 opens at the center, and side wall sections 144 which extend from the outer circumferential edge of the frame section 140 toward the head case 118. Further, in both the side wall sections 144 (see FIG. 5) in a direction perpendicular to the nozzle arrays, ear-shaped anchoring sections 145 extend toward the sides. In the anchoring sections 145, anchoring holes 147 open, into which anchoring pins 146 for mounting the head cover 119 on the head case 118 are inserted. In addition, the side wall sections 144 are connected to a ground line (not shown), which is connected to the printer 101. Accordingly, the head cover 119 is adjusted to have the ground potential.

The exposure window 143 of the head cover 119 has a sash shape so as to expose the nozzle arrays 116, and the size (internal size) thereof is set to be smaller than the nozzle plate 117. Therefore, when the head cover 119 is mounted on the head case 118, the nozzle plate 117 is exposed from the exposure window 143 while overlapping a part of the frame section 140 of the head cover 119.

The frame section 140 is formed in a substantially rectangular frame shape, and has a contact projection 148 which projects from the frame section 140 toward the liquid ejecting surface of the nozzle plate 17. The contact projection 148 is brought into contact with the metallic base material portion of the liquid ejecting surface of the nozzle plate 117 in a state in which the head cover 119 is mounted on the head case 18.

The contact projection 148 in this embodiment is provided in the inner circumferential edge of the exposure window 143 of the head cover 119.

Figure 6A:
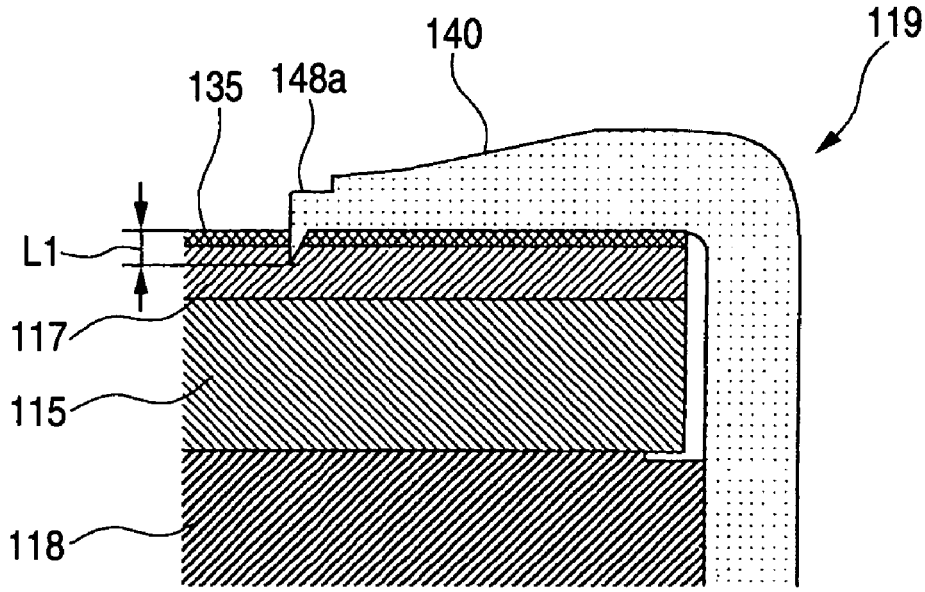
FIG. 6A is a section view taken along a line VIA-VIA in FIG. 5, showing a first example of a contact projection.

As shown in FIG. 6A, the contact projection 148 the front end of which projects toward the liquid ejecting surface from the rear surface of the frame section 140 to be brought into contact with the nozzle plate 117, is provided along the entire inner circumferential edge of the exposure window 143. Specifically, the sharp front end of the contact projection 148 projects by 20 μm from the rear surface of the frame section 140 toward the nozzle plate 117. That is, L1 in FIG. 6A is set to 20 μm. In addition, in a state where the head cover 119 is mounted on the head case 118, a surface pressure applied to the anchoring section 145 when the anchoring pin 146 is mounted is applied to the frame section 140 through the side wall section 144. And then, a force, which presses the contact projection 148 toward the liquid ejecting surface direction of the nozzle plate 117, is also applied to the contact projection 48. Accordingly, even when the liquid repellent coating layer 135 having a high insulation property exists on the liquid ejecting surface of the nozzle plate 117, the contact projection 148 passes through the liquid repellent coating layer 135 so as to be brought into contact with the metallic base material portion of the nozzle plate 117. Therefore, the connection can be reliably ensured by the contact projection 148, and thus the nozzle plate 117 can be adjusted to have the ground potential through the head cover 119. Accordingly, even though the liquid repellent coating layer 135 having high liquid repellency is formed on the liquid ejecting surface of the nozzle plate 117, an inconsistency, such as an electrostatic breakdown or an erroneous operation of a driving circuit or the like due to static electricity, can be prevented.

Further, according to the present example, the contact projection 148 is provided over the entire inner circumferential edge of the exposure window 143 of the head cover 119. Therefore, a clearance between the head cover 119 and the nozzle plate 117 can be blocked by the contact projection 148. Accordingly, although misty ink droplets are slightly ejected from the nozzle orifices, the ink droplets can be prevented from intruding into the head cover 119 from the exposure window 143 of the head cover 119. In addition, the recording medium, such as a recording paper or the like, can be prevented from being caught in the clearance between the head cover 119 and the nozzle plate 117.

Moreover, the contact projection 148 may be formed by using a burr which is generated by a pressing process when the exposure window 143 is formed, If doing so, since the direction where the burr and the contact projection 148 project can be the same, the contact projection 148 can be easily formed, without needing a new process.

Figure 6B:
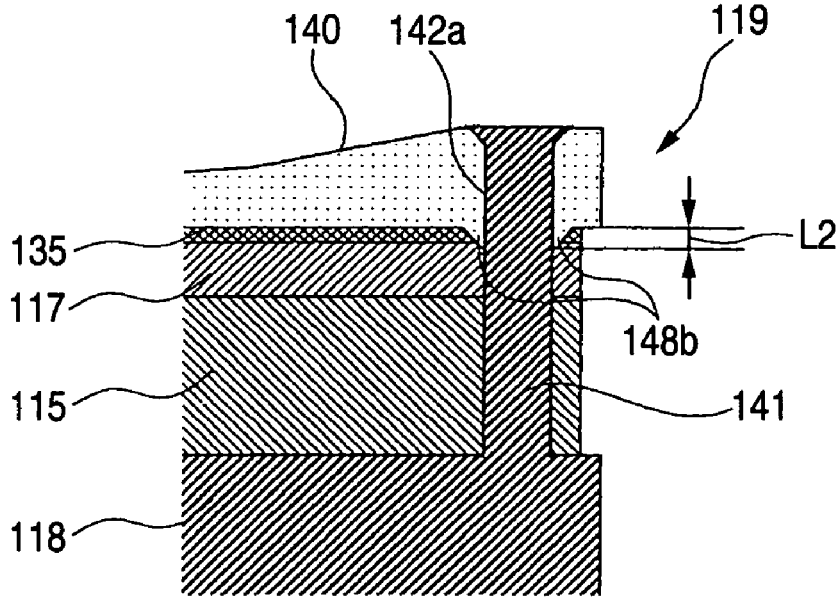
FIG. 6B is a section view taken along a line VIB-VIB in FIG. 5, showing a second example of the contact projection.

The contact projection 148 may be provided on the inner circumferential edge of the positioning hole 142*a* of the head cover 119 as shown in FIG. 6B.

Specifically, the contact projection 148, the front end of which projects toward the liquid ejecting surface of the nozzle plate 117 from the inner circumferential edge of the positioning hole 142*a* in the frame section 40, is provided on the entire inner circumferential edge of the positioning pin 142*a*. Specifically, the ring-shaped front end of the contact projection 148 projects, for example, by 20 μm from the rear surface of the frame section 140 toward the nozzle plate 117. That is, L2 in FIG. 6B is set to 20 μm. In addition, in a state in which the head cover 119 is mounted on the head case 118, the surface pressure applied to the anchoring section 145 when the fixing pin 146 is mounted is applied to the frame section 140 through the side wall section 144. Further, a pressure applied by caulking of the positioning pin 141 is also applied around the positioning hole 142*a*. Therefore, a force is applied to the contact projection 148 toward the liquid ejecting surface of the nozzle plate 117. Accordingly, even when the liquid repellent coating layer 135 having a high insulation property exists on the liquid ejecting surface of the nozzle plate 117, the contact projection 148 passes through the liquid repellent coating layer 135 so as to be brought into contact with the metallic base material portion of the noble plate 117, such that the connection can be reliably ensured. Therefore, the nozzle plate 117 can be adjusted to have the ground potential through the head cover 119. For this reason, even though the liquid repellent coating layer 135 having high liquid repellency is formed on the liquid ejecting surface of the nozzle plate 117, the inconsistency, such as the electrostatic breakdown or the erroneous operation of a driving circuit or the like due to the static electricity can be prevented.

Further, according to the present example, since the contact projection 148 is provided on the inner circumferential edge of the positioning hole 42*a* of the head cover 119, in a state where the head cover 119 is mounted on a head case 118, the force is applied toward the liquid ejecting surface, as described above. Accordingly, the contact projection 148 bites into the nozzle plate 117, such that misalignment of the head cover 119 can be suppressed. Therefore, when the head cover 119 is mounted, position accuracy when the positioning pin 141 is inserted for positioning can be maintained after mounting.

Figure 7A:
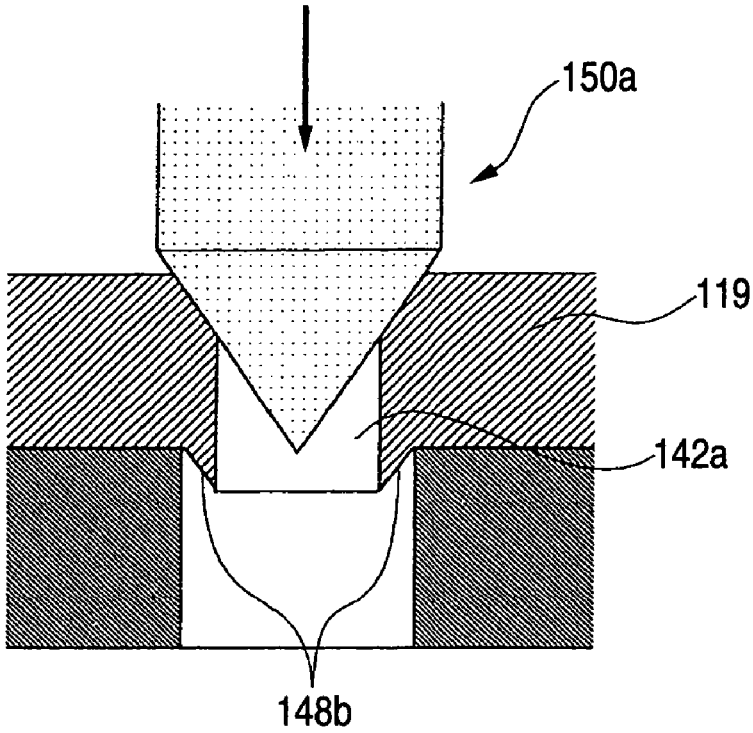
FIGS. 7A and 7B are schematic section views for explaining how to form the contact projection.

The contact projection 148 in the present example may be formed by using a burr or bulge which is generated by a punching process when the positioning hole 142 is formed. For example, after a through hole (the positioning hole 42*a*) opens in the head cover 119, as shown in FIG. 7A, a punch

150*a* whose end is sharp is pressed into the through hole, such that the contact projection 148 can be formed in a shape according to the punch 150*a*.

Figure 7B:
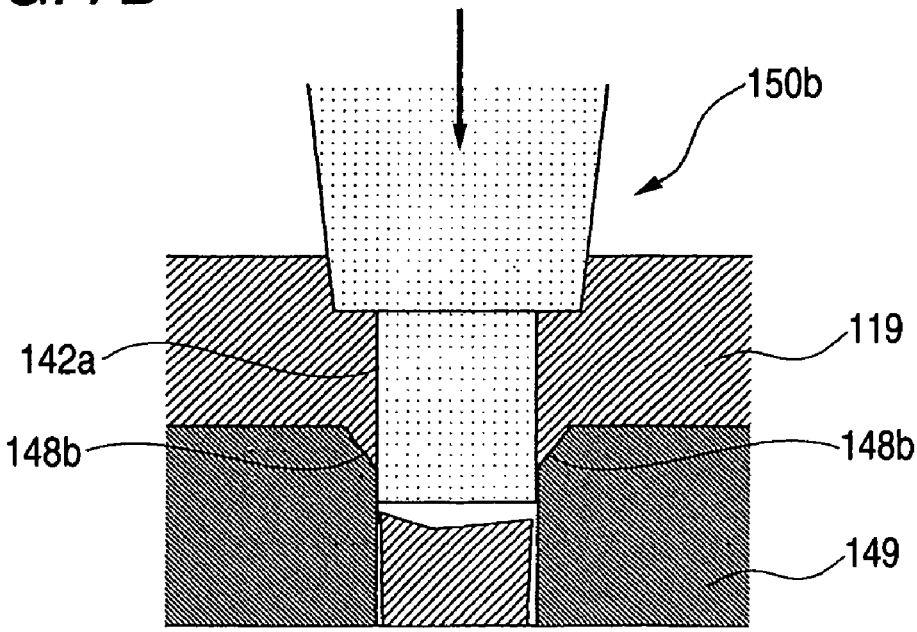

Further, as shown in FIG. 7B, for example, a mold of the contact projection hole 148 is previously created in a die 149 which is used for a punching process. When the through hole (the positioning hole 142*a*) opens through the punching process, the positioning hole 142*a* and the contact projection 148 can be formed at the same time , while the bulge extruded by the punch 150*b* is formed in a shape according to the mold of the die 149.

Further, the contact projection 148 may be provided in both the inner circumferential edge of the exposure window 143 of the head cover 119 and the inner circumferential edge of the positioning hole 142*a*.

In a region on the liquid ejecting surface of the nozzle plate 117 where the contact projection 148 comes into contact with the liquid ejecting surface of the nozzle plate 117, the contact projection 148 may come into contact with the liquid ejecting surface of the nozzle plate 117 after the liquid repellent coating layer 135 is removed in advance by the irradiation of ultraviolet rays. In this case, the contact projection 148 can be reliably brought into contact with the metallic base material portion of the liquid ejecting surface of the nozzle plate 117, regardless of the surface pressure applied to the frame section or the pressure from the positioning pin, in a state where the head cover is mounted.

In this embodiment, the contact projection 148 is provided on the entire inner circumferential edge of the frame section 140. However, the contact projection 148 may be provided on at least a portion of the inner circumferential edge of the frame section 140. In this case, as long as the connection between the contact projection 148 and the liquid ejecting surface of the nozzle plate 117 can be ensured, the contact projection 148 can have any shape.

Figure 8:
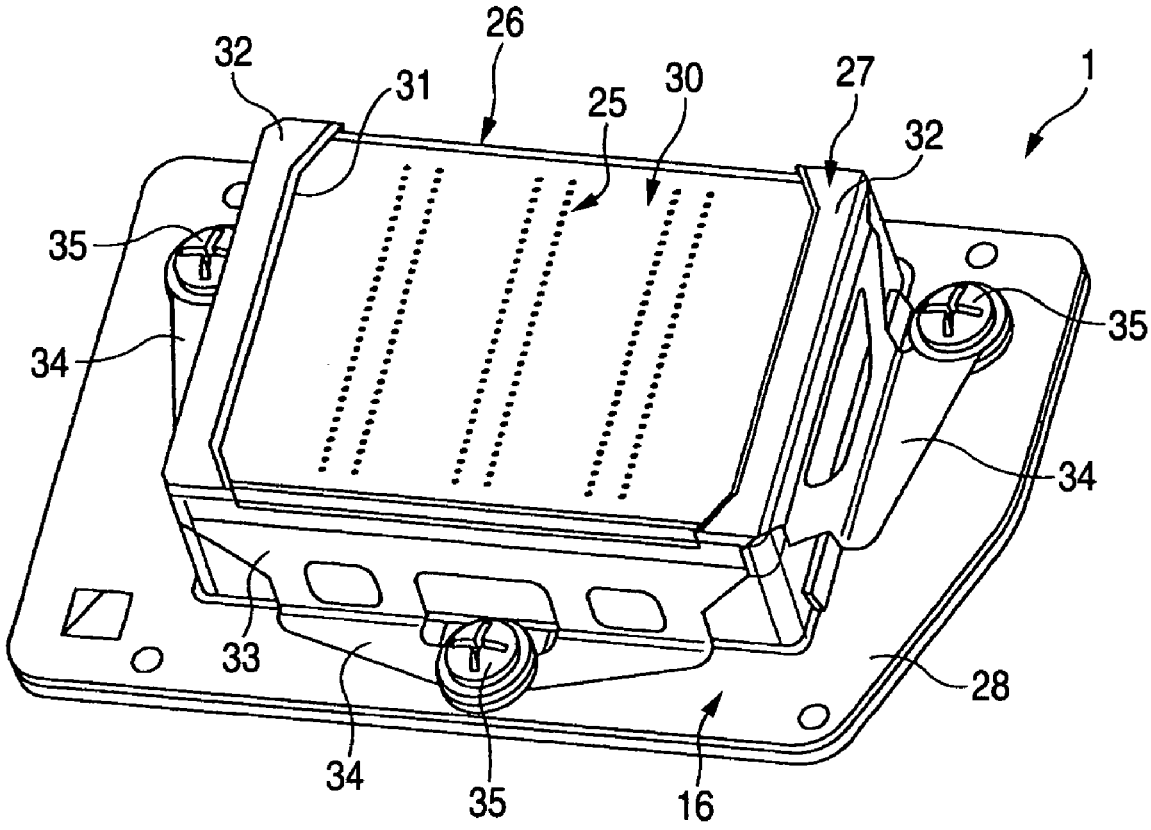
FIG. 8 is a perspective view of an ink jet recording head according to second embodiment of the invention.
Figure 9:
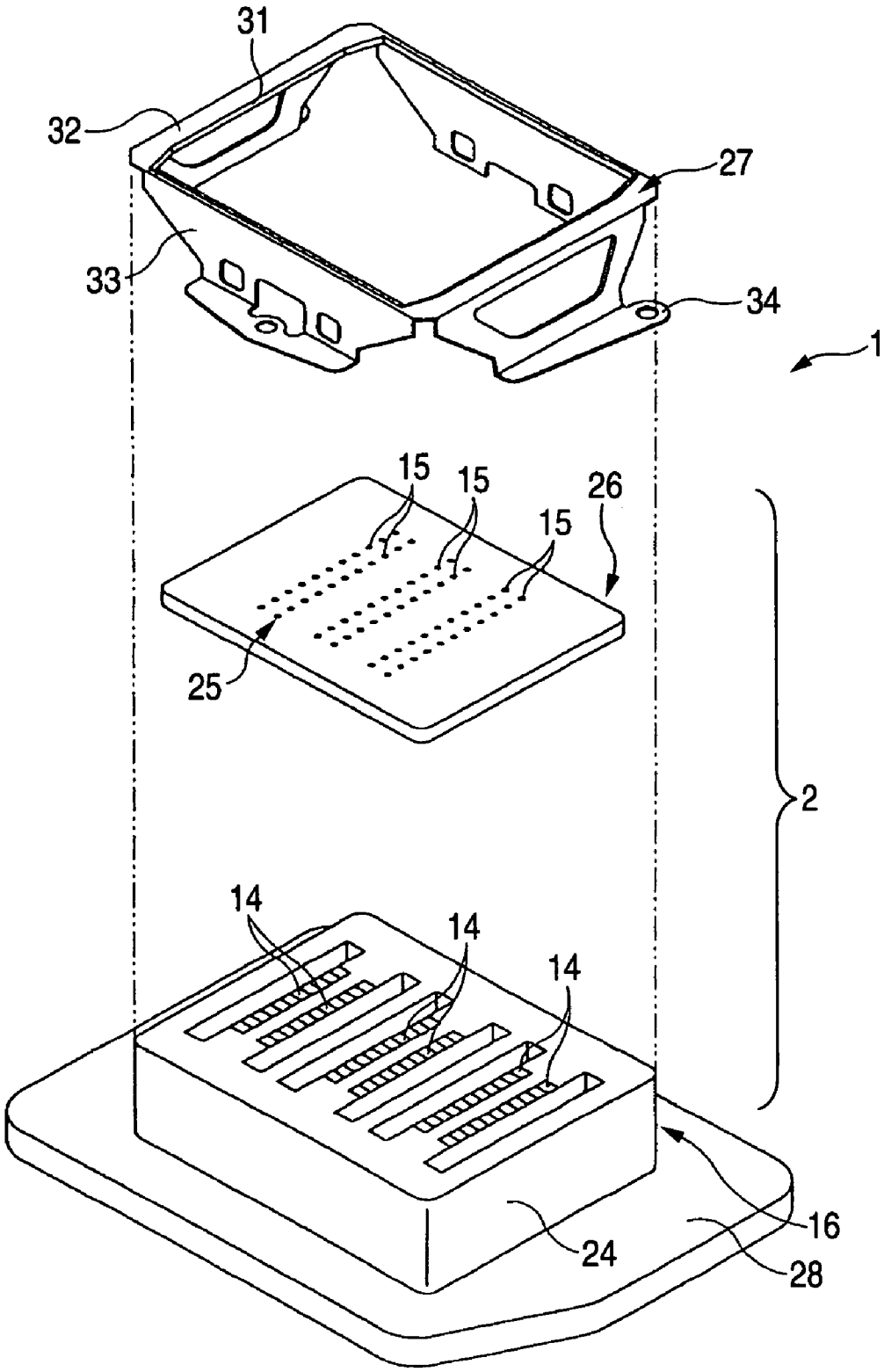
FIG. 9 is a perspective view showing a disassembled state of the ink jet recording head of FIG. 8.
Figure 10:
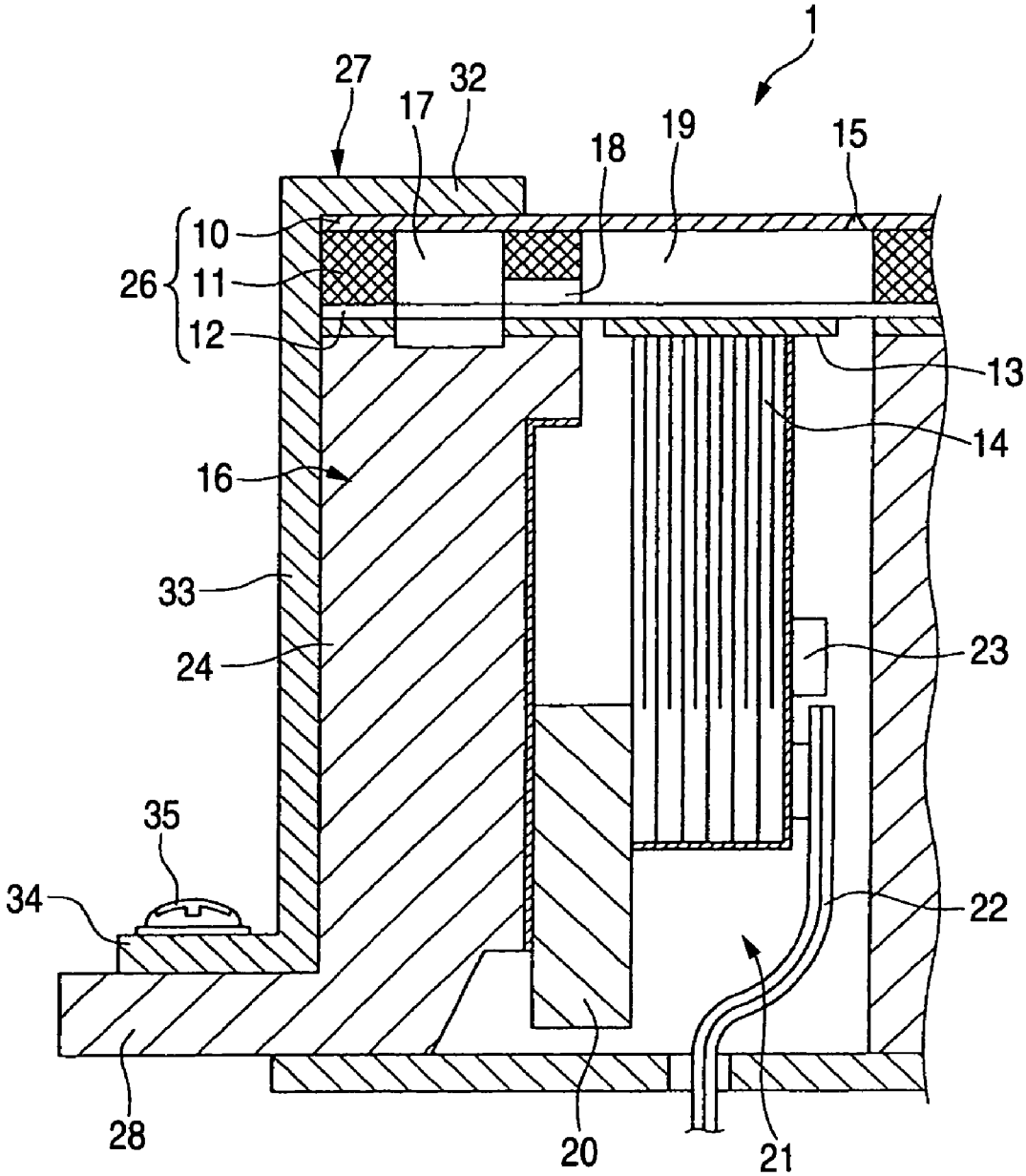
FIG. 10 is a section view of the ink jet recording head of FIG. 8.

Next, a second embodiment of the invention will be described. As shown in FIGS. 8 to 10, an ink jet type recording head 1 is provided with a head case 16 in which a piezoelectric vibrator 14 is housed, a flow passage unit 26 which is fixed to a unit fixing face of the head case 16 by an adhesive, and a head cover 27 which covers the flow passage unit 26.

The flow passage unit 26 is a laminated body of a flow passage forming substrate 11 in which a flow passage space including pressure generating chambers 19 arranged and an ink reservoir 17 for storing ink to be supplied to the individual pressure generating chambers 19, a nozzle plate 10 which is laminated on one surface of the flow passage forming substrate 11 and which has nozzle orifices 15 to eject ink within the pressure generating chambers 19, a vibration plate (sealing plate) 12 which is laminated on the other surface of the flow passage forming substrate 11 to seal the flow passage space including the pressure generating chambers 19. The flow passage unit 26 eject ink pressed by the piezoelectric vibrator 14 from the nozzle orifices 15 of the nozzle plate 10.

On the nozzle plate 10, nozzle arrays 25 are formed, in each of which the plurality of nozzle orifices 15 are arranged. In this embodiment, six nozzle arrays 25 are formed to eject different types of ink The nozzle plate 10 is mainly formed of a conductive material, such as a stainless plate or the like.

In the flow passage forming substrate 11, the pressure generating chambers 19 are arranged to be correspondingly connected to the nozzle orifices 15. In addition, the common ink reservoir 17, which is connected to the individual pressure generating chambers 19 through an ink supply passage 18 so as to store ink to be supplied to the individual pressure generating chambers 19, is formed to be disposed along the pressure generating chambers 19. The flow passage forming substrate 11 is formed by etching a monocrystalline silicon substrate.

The vibration plate 12 is formed of a resin film, such as a polyphenylene sulfide film, on which an island section 13 formed of a stainless plate or the like is laminated.

The flow passage unit 26 is constructed by laminating the nozzle plate 10 on one surface of the flow passage forming substrate 11 and by laminating the vibration plate 12 on the other surface thereof such that the island section 12 is disposed outside. The flow passage forming substrate 11, the nozzle plate 10, and the vibration plate 12 are laminated by an adhesive, are heated and held at a predetermined high temperature while being pressed in a vertical direction, and then are cooled down to a room temperature, thereby forming the flow passage unit 26.

The head case 16, which is formed by injecting thermosetting resin or thermoplastic resin, has a body section 24 which houses the piezoelectric vibrator 14, and a flange section 28 which is formed in an opposite side to the unit fixing face of the body section 24.

The body section 24 has vertical housing spaces 21, in which the piezoelectric vibrators 14 are housed to correspond to the individual pressure generating chambers 19. Six housing spaces 21 extending along the nozzle arrays 25 are provided to correspond to the individual nozzle arrays 25 (in FIG. 10, only one is shown). The piezoelectric vibrator 14 is a piezoelectric vibrator 14 in a longitudinal vibration mode, and a back end thereof is fixed to the fixing plate 20.

The flange section 28 is formed on an opposite side to the unit fixing face of the body section 24 so as to extend outward from an outer circumference of the body section 24 to be stretched.

Further, in a state in which the vibration plate 12 of the flow passage unit 26 is bonded to the unit fixing face of the head case 16 by an adhesive, a front end face of the piezoelectric vibrator 14 is fixed to the island section 13 of the vibration plate 12, and the fixing plate 20 is bonded and fixed to the head case 16.

The head cover 27 is formed by bending a conductive metal plate, such as a stainless plate or the like. The head cover 27 is mounted on a head body 2 in which the flow passage unit 26 is fixed to the head case 16, so as to cover the flow passage unit 26.

The head cover 27 is formed in a substantially frame shape so as to cover the outer circumference of the head body 2, and has a window 31 for exposing the nozzle orifices 15 of the nozzle formation face 30. The head cover 27 includes a cover section 32 which covers the nozzle formation face 30 in a peripheral portion of the window 31, side face sections 33 which are bent from the cover section 32 so as to cover the side faces of the head case 16, and screwing sections 34 which are bent from the side face sections 33 so as to screw the head cover 27.

The head cover 27 covers both end portions in a direction in which the cover section 32 is perpendicular to the nozzle arrays 25 of the nozzle formation face 30. The side face sections cover the end portions of the flow passage unit 26 and the side faces of the head case 16. Further, the screwing sections 34 are screwed by screws 35 with respect to the flange section 28 of the head case 16.

The screwing sections 34 are formed on both sides in the direction perpendicular to the nozzle arrays 25 of the head cover 27 (a primary scanning direction in which the recording head 1 is moved by a carriage) and on one side in the direction along the nozzle arrays 25 (a secondary scanning direction perpendicular to the primary scanning direction). The screwing sections 34 screw the head cover 27 at three places.

The screws 35 screwed to the screwing sections 34 are configured such that the head cover 27 is mounted on the head case 16, and the head body 2 is mounted on the carriage (not shown). The screwing sections 34 formed on both sides in the primary scanning direction are formed in the vicinities of the opposite side to one screwing section formed on one side in the secondary scanning direction, thereby supporting the head body, which is rectangular in plan view, at three points.

In the recording head 1 having such a configuration, a driving signal generated by a driving circuit 23 is input to the piezoelectric vibrator 14 through a flexible circuit board 22, such that the piezoelectric vibrator 14 expands and contracts in a longitudinal direction. With the expansion and contraction of the piezoelectric vibrator 14, the island section 13 of the vibrating body 12 vibrates, and thus a pressure within the pressure generating chamber 19 changes. And then, ink within the pressure generating chamber 19 is ejected as ink droplets from the nozzle orifices 15.

The recording head 1 is mounted on the carriage which reciprocates in a widthwise direction of a recording paper, ejects ink droplets onto the recording paper while the carriage moves, and prints images or characters onto the recording paper in a dot matrix manner.

Figure 11A:
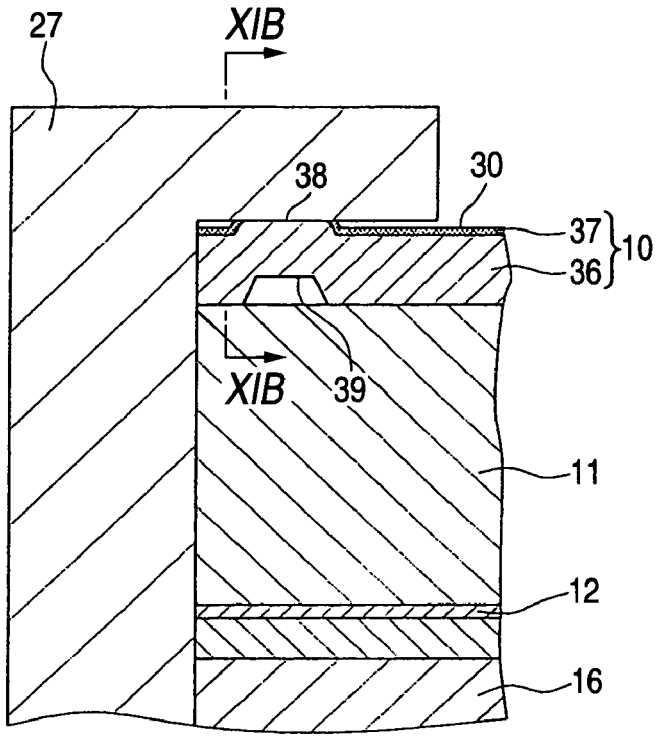
FIG. 11A is an enlarged section view showing a state that a head cover and a nozzle plate are electrically connected via contact projections in the ink jet recording head of FIG. 8.
Figure 11B:
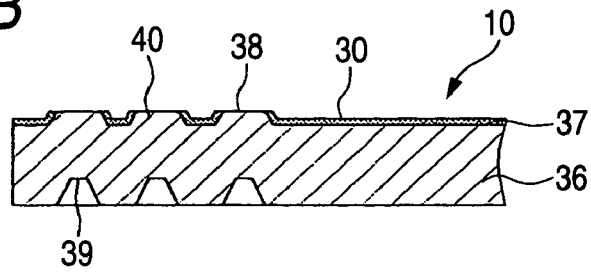
FIG. 11B is an enlarged section view of the nozzle plate of FIG. 11A.
Figure 11C:
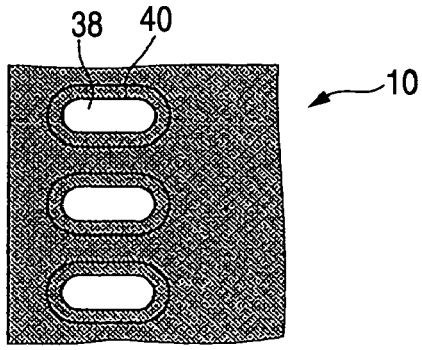
FIG. 11C is an enlarged top plan view of the nozzle plate of FIG. 11A.
Figure 12:
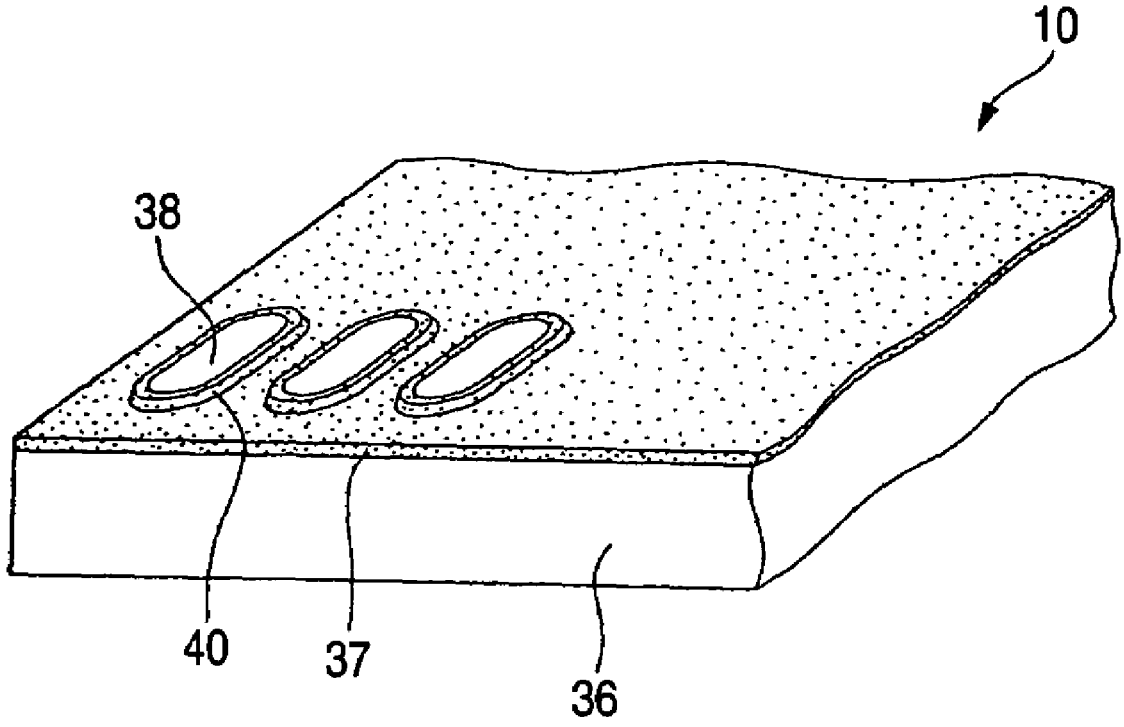
FIG. 12 is an enlarged perspective view of the nozzle plate of FIG. 11A.

As shown in FIGS. 11A through 12, in the nozzle plate 10, an insulating film 37 is formed on the nozzle formation face (to be opposed to a recording medium) of a conductive mother material 36 formed of stainless steel or the like. The thickness of the conductive mother material is not particularly limited, but is set to about 30 to 120 μm in accordance with ejecting characteristics. The thickness of the insulating film 37 is not particularly limited, but is set to about 0.1 to 1 μm, which is much thinner than the thickness of the conductive mother material 36.

The insulating film 37 is, for example, a glassy film which exhibits water repellency. On the nozzle formation face 30 of the conductive mother material 36, for example, a plasma-polymerized film is formed by plasma-polymerizing a silicon material. And then, a metal-alkoxide molecular film having liquid repellency is formed on the plasma-polymerized film.

As a raw material of the plasma-polymerized film, silicone oil, alkoxysilane, and specifically, dimethylpolysiloxane, are exemplified. As a product, TSF451 (available from GE Toshiba Silicones), SH200 (available from Dow Corning Silicones), or the like can be used. The plasma-polymerized film can be formed through the following process, for example. The plasma-polymerized film can be formed by disposing the nozzle plate 10 within a chamber, which is aspirated at a predetermined negative pressure, and by purifying argon plasma within the chamber while supplying evaporated silicone as a raw material.

As the metal-alkoxide molecular film, any film having water repellency and oil repellency may be used. Preferably, a metal-alkoxide mono-molecular film having a long-chain polymer group (hereinafter, referred to as long-chain RF group) including fluorine or a metalate mono-molecular film having a liquid repellent group is used. As the metal alkoxide, Ti, Li, Si, Na, K, Mg, Ca, St, Ba, Al, In, Ge, Bi, Fe, Cu, Y, Zr, Ta, or the like, can be used but silicon, titanium, aluminum, zirconium, or the like is generally used. In the present embodiment, a silicon-based product is used. Preferably, alkoxysilane having the long-chain RF group including fluorine or metalate having a liquid repellent group may be used.

As the long-chain RF group whose molecular weight is 1000 or more, perfluoroalkyl chain, perfluopolyether chain, or the like is exemplified. As alkoxysilane having the long-chain RF group, a silane coupling agent having the long-chain RF group or the like is exemplified. As the silane coupling agent having the long-chain RF group which is suitable as a liquid repellent film of the present invention, heptatriaconta fluoroicosyl trimethoxysilane or the like is exemplified, for example. As a product, however, OPTOOL DSX (Trademark, available from Daikin Industries, Ltd.) and KY-130 (Trademark, available from Shin-Etsu Chemical Co., Ltd.) are exemplified. Since a carbon-fluorine group (RF group) has a surface free energy smaller than an alkyl group, when the metal alkoxide contains the RF group, liquid repellency of the liquid repellent film to be formed can be improved, and characteristics, such as chemical resistance, weather resistance, and friction resistance, can be also improved. In addition, as the R F group, a group whose long-chain structure is long can further keep liquid repellency. As the metalate having a liquid repellent group, aluminate, titanate, and the like are exemplified.

The metal-alkoxide molecular film is formed by heating the nozzle plate 10 on which the plasma-polymerized film is formed in a range of 200 to 400° C. and by dipping into a solution in which metal alkoxide is mixed with a solvent, such as a thinner or the like, such that the concentration thereof is adjusted to, for example, 0.1 weight percent.

Moreover, a water repellent film is not limited to the above-described films, but various films, such as a fluorine resin film or the like, can be applied.

On the nozzle formation face 30 of the nozzle plate 10, an exposure section 38 is formed, where the insulating film 37 is removed such that the conductive mother material 36 is exposed to the nozzle formation face 30 Through the exposure section 38, the head cover 27 formed of a conductive material and the conductive mother material 36 of the nozzle plate 10 are electrically connected to each other.

In this embodiment, the exposure section 38 is formed as follows. That is, by forming a concave section 39 in the back face on the opposite side to the nozzle formation face 30 of the nozzle plate 10, a contact projection 40 is formed where the conductive mother material 36 projects on the nozzle formation face 30 of the nozzle plate 10. Further, a top region of the contact projection 40 is formed in the exposure section 38 where the insulating film 37 is removed so as to expose the conductive mother material 36.

The concave section 39 and the contact projection 40 can be formed by performing laser marking on the back face (opposite to the nozzle formation face 30) of the nozzle plate 10, such that the concave section 39 on the back face is formed and the contact projection 40 is formed to be swollen. Alternatively, press molding is performed in which a punch is pressed into the back face of the nozzle plate 10, such that the concave section 39 is formed on the back face and the contact projection 40 is formed on the nozzle formation face 30 to be swollen.

The contact projection 40 of the conductive mother material 36 is set to have a projection height larger than the thickness of the insulating film 37, and thus the top region of the contact projection 40 projects from the surface of the insulating film 37 toward the nozzle formation face 30, such that the conductive mother material 36 is exposed to the nozzle formation face 30. That is, the thickness of the insulating film 37 is set to be in a range of about 0.1 to 1 μm, while the projection height of the conductive mother material 36 of the contact projection 40 from the nozzle formation face 30 is set to, for example, about 3 to 6 μm. When the concave section 39 and the contact projection 40 are formed by laser marking, if the concave section 39 and the contact projection 40 have the same base material quality, the projection height of the contact projection 40 is changed according to the laser intensity at the time of laser marking. Therefore, control and management can be performed by regulating the laser intensity. In addition, when the contact projection 40 is formed by press molding, the projection height of the contact projection 40 can be controlled and managed by regulating a pressing degree of the punch.

As shown in FIGS. 11C and 12, a plurality of contact projections 40 are formed on the nozzle formation face 30 in the vicinity of one edge of the nozzle plate 10.

Figure 13A:
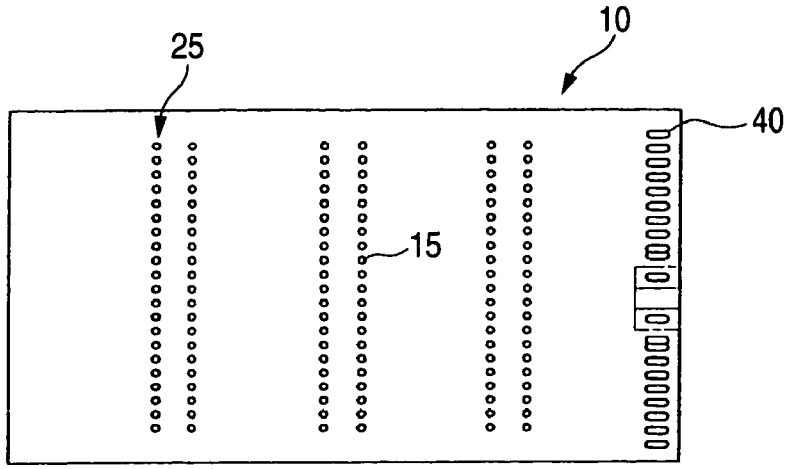
FIG. 13A is an entire plan view of the nozzle plate of FIG. 11A.

As shown in FIG. 13A, the contact projections 40 are arrayed parallel to the nozzle arrays 25 on one of both sides in the primary scanning direction.

Figure 14:
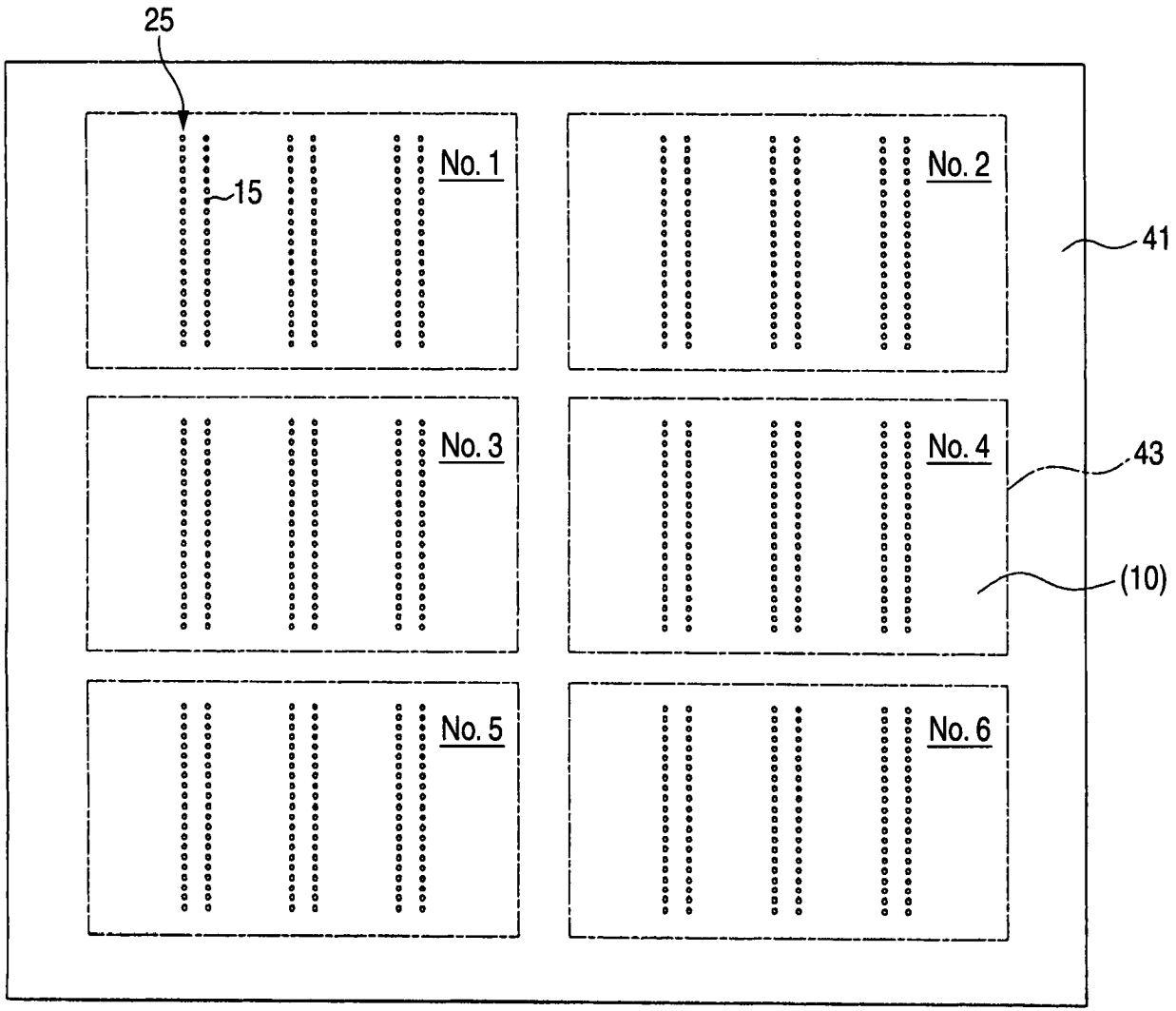
FIGS. 14 and 15 are plan views for explaining how to make the nozzle plate of FIG. 11A.

As shown in FIG. 14, the nozzle plate 10 is formed by cutting out the plurality of nozzle plates 10 from one base material plate 41. In this embodiment, six nozzle plates 10 are cut out from one base material plate 41 by punching with a press. Reference numeral 43 represents a punching proposed line which serves as a contour line at the time of punching.

Further, when the plurality of nozzle plates 10 are cut out from one base material plate 41 in such a manner, the arrangement of the nozzle plates 10 in the base material plate 41 is marked as arrangement addresses on the individual nozzle plates 10, which can be used to analyze defects of the cut nozzle plate 10. In this embodiment, the contact projections 40 for the electrical connection between the head cover 27 and the nozzle plate 10 also serve as the marks of arrangement addresses.

According to the arrangement in the base material plate 41, No. 1, No. 2, No. 3, No. 4, No. 5, and No. 6 (arrangement addresses) are allocated to the individual nozzle plates 10. The arrangement addresses are marked and displayed on the individual nozzle plates 10 by forming the contact projection 40.

Figure 13B:
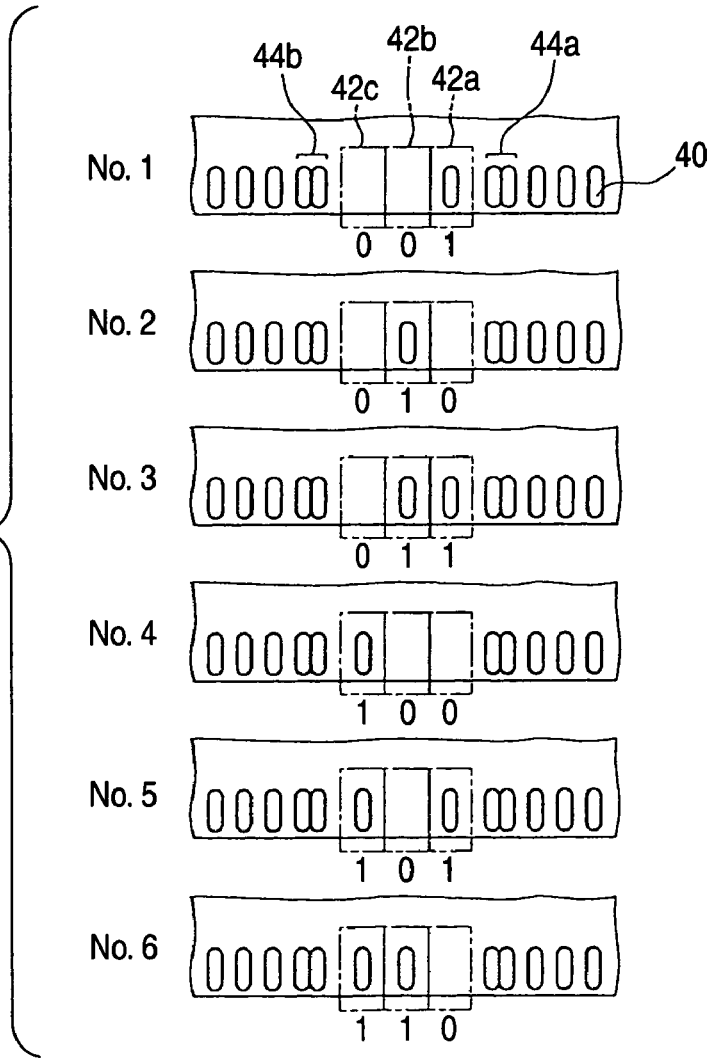
FIG. 13B is a diagram for explaining arrangement addresses formed by the contact projections.

As shown in FIG. 13B, the arrangement addresses are marked and displayed on the individual nozzle plates 10 by the contact projections 40, On the nozzle plate 10, a plurality of proposed regions 42*a*, 42*b*, and 42*c* for displaying the arrangement addresses are formed. In each of the proposed regions 42*a*, 42*b*, and 42*c*, one contact projection 40 is formed.

On both sides of the proposed regions 42*a*, 42*b*, and 42*c*, a start point mark 44*a* and an end point mark 44*b* are formed in which two contact projections 40 are provided close to each other with no gap. The region which is interposed between the start point mark 44*a* and the end point mark 44*b* is an arrangement address displaying region. In regions outside the start point mark 44*a* and the end point mark 44*b*, the contact projections 40 are provided in parallel at constant pitches.

The number of proposed regions 42*a*, 42*b*, and 42*c* are formed by at least the number of digits in a binary number when the binary number represents the number of nozzle plates 10 to be cut out from the base material plate 41. In this embodiment, since six nozzle plates 10 are cut out from one base material plate 41 and the number of digits of '110', which is a binary number of '6', is '3', at least three proposed regions 42*a*, 42*b*, and 42*c* are provided. In this embodiment, four or more proposed regions may be provided, and only three of them may be used.

Among three proposed regions 42*a*, 42*b*, and 42*c*, according to whether or not the contact projection 40 is formed in the proposed region 42*a* close to the start point mark 44*a*, '1' or '0' of a digit of 1 in the binary number is displayed, according to whether or not the contact projection 40 is formed in the next proposed region 42*b*, '1' or '0' of a digit of 2 in the binary number is displayed, and according to whether or not the contact projection 40 is formed in the next proposed region 42*c*, '1' or '0' of a digit of 4 in the binary number is displayed, such that the arrangement address is displayed. Here, in this embodiment, when the contact projection 40 is formed , '1' is displayed, and, when the contact projection 40 is not formed, '2' is displayed.

That is, in the nozzle plate 10 whose arrangement address is 'No. 1', the contact projection 40 is formed in the proposed region 42*a* of the digit of 1, not in the proposed region 42*b* of the digit of 2 and in the proposed region 42*c* of the digit of 4, thereby displaying a binary number '001', that is, the arrangement address '1'. In the nozzle plate 10 whose arrangement address is 'No. 2', the contact projection 40 is formed in the proposed region 42*b* of the digit of 2, not in the proposed region 42*a* of the digit of 1 and in the proposed region 42*c* of the digit of 4, thereby displaying a binary number '010', that is, the arrangement address '2'.

In the nozzle plate 10 whose arrangement address is 'No. 3', the contact projections 40 are formed in the proposed region 42*a* of the digit of 1 and in the proposed region 42*b* of the digit of 2, not in the proposed region 42*c* of the digit of 4, thereby displaying a binary number '011', that is, the arrangement address '3'. In the nozzle plate 10 whose arrangement-address is 'No. 4', the contact projection 40 is formed in the proposed region 42*c* of the digit of 4, not in the proposed region 42*a* of the digit of 1 and in the proposed region 42*b* of the digit of 2, thereby displaying a binary number '100', that is, the arrangement address '4'.

Similarly, in the nozzle plate 10 whose arrangement address is 'No. 5', a binary number '101', that is, the arrangement address '5' is displayed. In the nozzle plate 10 whose arrangement address is 'No. 6', a binary number '110', that is, the arrangement address '6' is displayed.

In this embodiment, the plurality of proposed regions 42*a*, 42*b*, and 42*c* are provided along the edge of the nozzle plate 10. Before the edge, the start point mark 44*a* is disposed on the right side, and the end point mark 44*b* is disposed on the left side. In order from the side close to the start point mark 44*a*, the proposed region 42*a* of the digit of 1, the proposed region 42*b* of the digit of 2, and the proposed region 42*c* of the digit of 4 are sequentially formed.

As such, according to whether or not the contact projection 40 is formed in each of the plurality of proposed regions 42*a*, 42*b*, and 42*c* of the arrangement address displaying region interposed between the start point mark 44*a* and the end point mark 44*b*, the arrangement address of the nozzle plate 10 in the base material plate 41 is displayed.

The nozzle plate 10 formed in such a manner is used to form the flow passage unit 26, thereby forming the recording head 1 (see FIGS. 8 to 10).

In this state, the head cover 27 is electrically connected to a case of the recording apparatus through a contact plate formed on the carriage and a guide bar for guiding the reciprocation of the carriage. Accordingly, the conductive mother material 36 of the nozzle plate 10 is grounded through the head cover 27.

Next, a method of manufacturing the recording head 1 of the present invention will be described.

First, a plate material of the conductive mother material 36 is prepared, and the nozzle orifices 15 are formed at predetermined positions inside the punching proposed line 43 by a pressing process or a laser process.

Figure 16A:
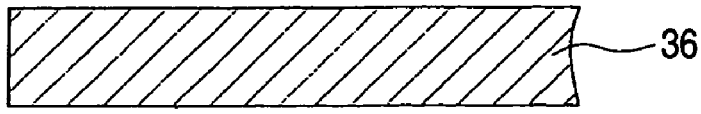
FIGS. 16A to 16D are section views for explaining how to make the nozzle plate of FIG. 11A.
Figure 16B:
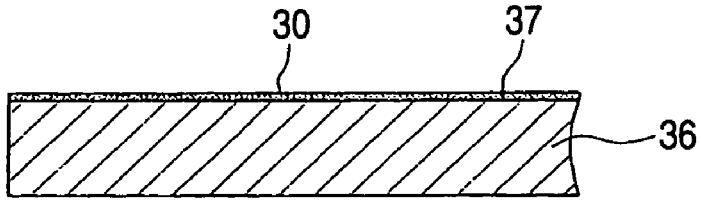

Next, as shown in FIGS. 16A and 16B, the insulating film 37 is formed on the nozzle formation face 30 of the base material plate 41 in which the nozzle orifices 15 are formed.

Figure 15:
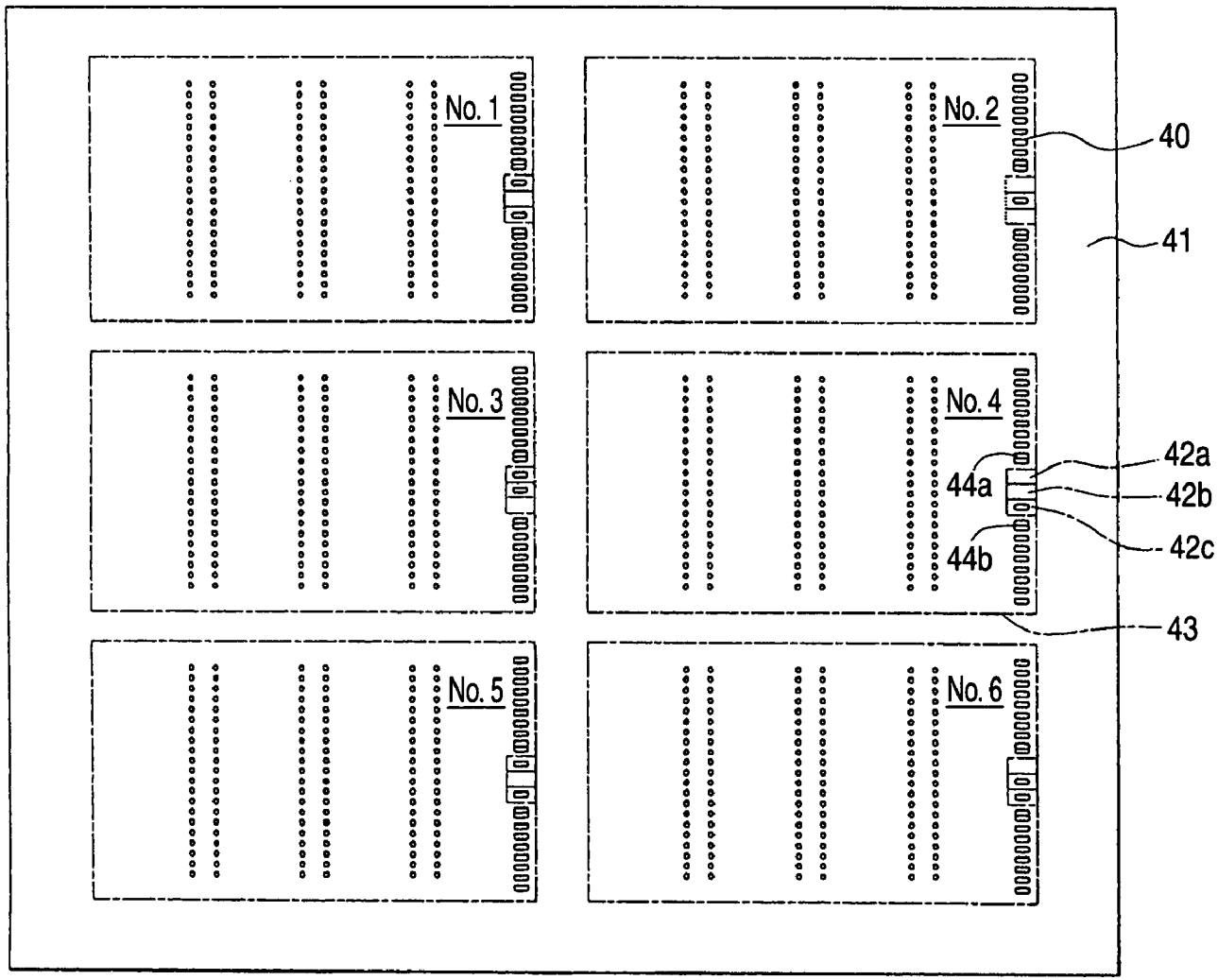
Figure 16C:
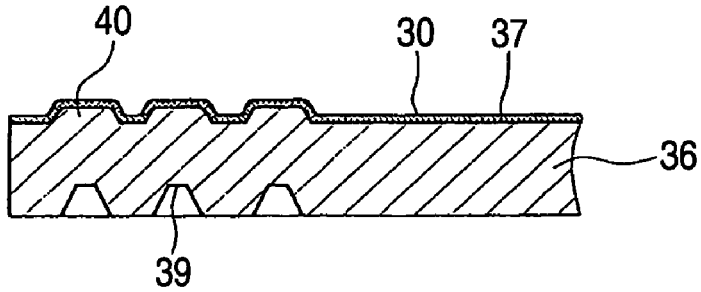

Next, as shown in FIGS. 15 and 16C, the concave section 39 is formed in the back face opposite to the nozzle formation face 30 of the base material plate 41, on which the insulating film 37 is formed, by laser marking or press molding. The contact projection 40 is formed to be swollen on the nozzle formation face 30 to correspond to the concave section 39. In this case, the plurality of contact projections 40 are arranged along the punching proposed line 43 in one end side parallel to the nozzle arrays 25 of on one side of both sides in the primary scanning direction in the region, which becomes the nozzle plate 10.

Figure 16D:
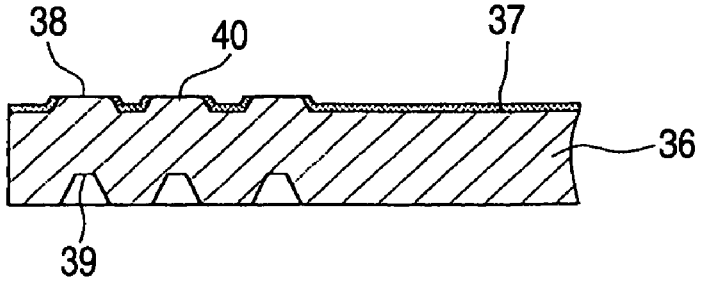

Next, as shown in FIG. 16D, the insulating film 37 in the top region of the contact projection 40 is removed to expose the conductive mother material 36, such that the exposure section 38 is formed. At this time, the insulating film 37 may be grinded and removed by performing a grinding process on the nozzle formation face 30 of the nozzle plate 10. Further, the insulating film 37 may be removed by friction between the head cover 27 and the top portion of the contact projection 40 when the head cover 27 is screwed, in particular, without using the removal process of the insulating film 37, In a process of assembling the head cover 27, when the exposure section 38 is formed in the contact projection 40, the electrical connection between the exposure section 38 and the head cover 27 may be ensured.

In addition, as described above, the start point mark 44*a* and the end point mark 44*b* are formed in each of the nozzle plates 10 by laser marking, and simultaneously, in the region outside the start point mark 44*a* and the end point mark 44*b*, the contact projections 40 are formed at constant pitches.

Further, as described above, the arrangement address of each nozzle plate is marked according to whether or not the contact projection 40 is formed in each of the plurality (three in this embodiment) of proposed regions 42*a*, 42*b*, and 42*c* which are provided between the start point mark 44*a* and the end point mark 44*b*.

Further, the punching proposed line 43 is cut so as to form the contour of the nozzle plate 10, such that the nozzle plate 10 shown in FIG. 13A is formed.

Figure 17A:
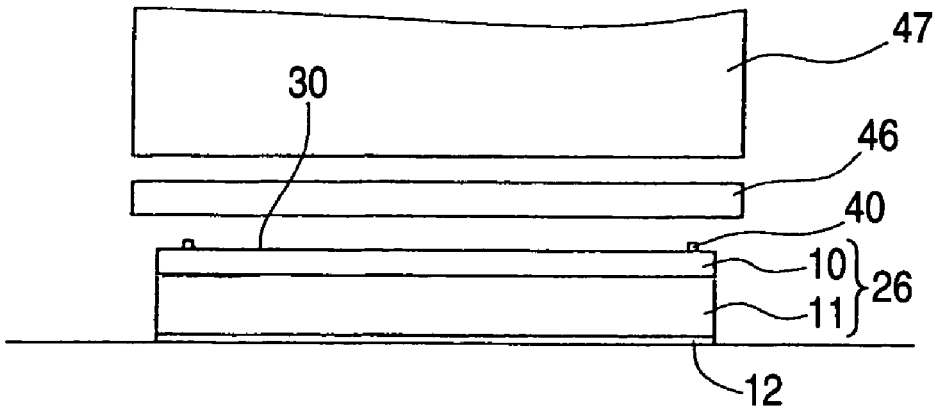
FIGS. 17A and 17B are side views for explaining how to make the ink jet recording head. of FIG. 8.

Next, as shown in FIG. 17A, the nozzle plate 10 formed in such a manner is laminated and bonded to the flow passage forming substrate 11 and the vibrating body 12 by the adhesive, thereby forming the flow passage unit 26. At this time, since the above-described contact projection 40 is formed on the nozzle formation face 30 of the nozzle plate 10, a cushion sheet 46 is disposed on the nozzle formation face 30 and then a pressure is applied by pressing with a press jig 47 through cushion sheet 46, such that bonding is performed.

Figure 17B:
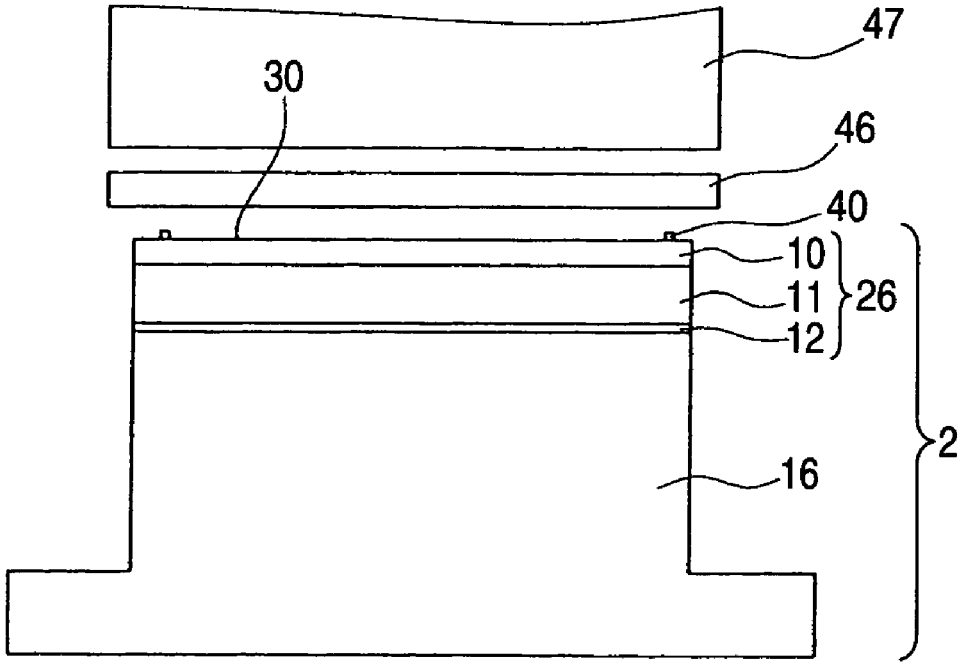

Next, as shown in FIG. 17B, the flow passage unit 26 formed in such a manner is bonded to the head case 16 by the adhesive, thereby forming the head body 2. At this time, the cushion sheet 46 is also disposed on the nozzle formation face 30 and a pressure is applied by pressing with the press jig 47 through the cushion sheet 46, such that bonding is performed.

As the cushion seat 46, for example, a fluorine resin sheet can be used. Since the projection height of the contact projection 40 is set in a range of about 3 to 6μm, the contact projection 40 can be sufficiently absorbed by the fluorine resin sheet, such that bonding is performed without unevenness.

Figure 18A:
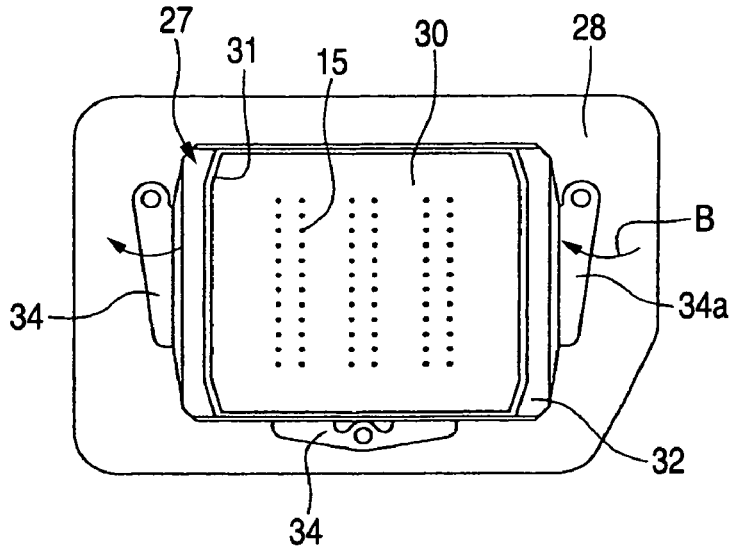
FIG. 18A is a plan view showing a state that the head cover is attached to a head case of the ink jet recording head of FIG. 8.

As shown in FIG. 18A, the head cover 27 is mounted on the head body 2 configured as described the above. That is, the head cover 27 is put on the head body 2 such that the nozzle orifices 15 of the nozzle formation face 30 are exposed from the window 31, and the three screwing sections 34 are screwed to the flange section 28 by the screws 35. And then, the head cover 27 is mounted on the head body 2. At this time, when the head cover 27 is screwed so as to cover the nozzle formation face 30 and the head case 16, the exposure section 38 of the top portion of the contact projection 40 is brought into contact with the head cover 27 and the contact projection 40 is electrically connected to the head cover 27.

At this time, as shown in FIG. 16C, the head cover 27 is mounted in a state in which the top portion of the contact projection 40 of the nozzle plate 10 is covered with the insulating film 37. By screwing at the time of mounting, the cover section 32 of the head cover 27 scrapes against the top region of the contact projection 40. And then, as shown in FIG. 16D, the insulating film 37 in the scraped region is peeled off, and the conductive mother material 36 is exposed so as to form the exposure section 38. As a result, the head cover 27 and the conductive mother material 36 of the nozzle plate 10 are electrically connected to each other.

Figure 19:
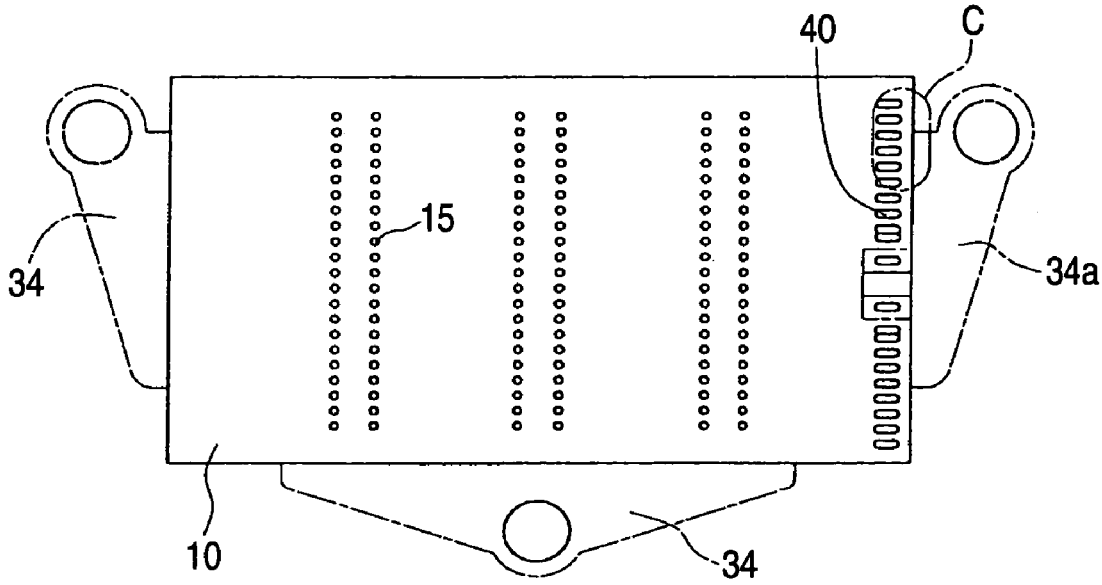
FIG. 19 is a schematic view showing a position relationship between the contact projections and a screwing section in the ink jet recording head of FIG. 8.

By screwing the screwing sections 34, a force, which presses the cover section 32 of the head cover 27 onto the nozzle formation face 30, acts on the head cover 27. Therefore, when the contact projection 40 is formed in the region close to the screwing section 34 of the head cover 27 on the nozzle formation face 30 of the nozzle plate 10, as shown in FIG. 19, the electrical connection between the contact projection 40 and the head cover 27 can be reliably ensured. In this embodiment, since the screwing sections 34 are formed on both sides in the primary scanning direction of the head body 2, the contact projections 40 are arranged in the region close to one end in the primary scanning direction of the nozzle plate 10.

Figure 18B:
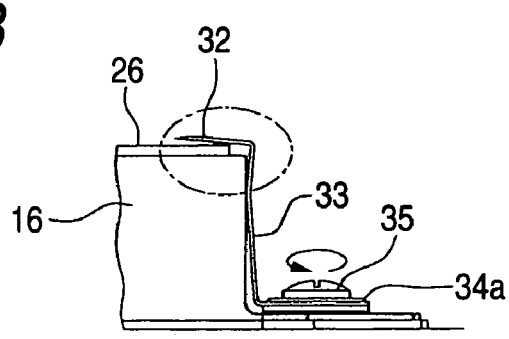
FIG. 18B is a side view showing a part of the state of FIG. 18A.
Figure 18C:
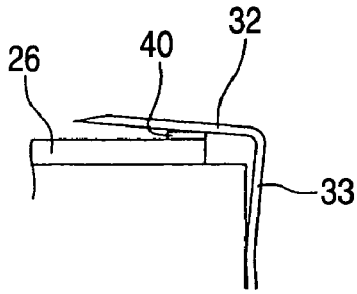
FIG. 18C is an enlarged side view of a circled part of FIG. 18B.

In the three screwing sections 34, a clockwise torque acts when a normal right-handed screw is screwed. Therefore, on the screwing section 34*a* on the right side of FIG. 18A among the three screwing sections 34, the force, which presses the cover section 32 onto the nozzle formation face 30 through the side face sections 33, acts due to a tightening torque when the head cover 27 is screwed (see FIGS. 18B and 18C). Therefore, as shown in FIG. 19, for the sake of the reliable electrical connection, the contact projection 40 may be formed in the region where the cover section 32 is pressed onto the nozzle formation face 30 through the side face sections 33 by the tightening torque when the head cover 27 is screwed. In this case, the region is a region C which is surrounded by a dashed line in Fig, 19.

With the above configurations, the conductive mother material 36 of the nozzle plate 10 and the head cover 27 are reliably connected to each other in the top region of the contact projection 40 formed on the nozzle formation face 30. Therefore, in the nozzle plate 10 on which the insulating film 37 is formed of a water repellent film or a hydrophilic film, static electricity flying from a paper to the nozzle plate 10 or the charges of the nozzle plate 10 can be effectively released through the head cover 27, and ejecting defects caused by dirt on the nozzle formation face 30 or a damage of an IC can be effectively prevented.

Further, the contact projection 40 of the conductive mother material 36 is set to have a projection height larger than the thickness of the insulating film 37, and thus the exposure section 38 is formed at a position which projects from the surface of the insulating film 37. Therefore, the electrical connection to the head cover 27 can be reliably ensured.

Further, when the concave section 39 and the contact projection 40 are formed by laser marking with respect to the back face of the nozzle plate 10, by forming the concave section 39 on the back face of the nozzle plate 10 through laser marking, the nozzle formation face 30 may be swollen, thereby forming the contact projection 40. Therefore, the contact projection 40 can be easily formed, manufacturing costs can be prevented from being unnecessarily increased, and position accuracy when the contact projection 40 is formed can be also improved. As a result, reliability can be ensured.

Further, when the concave section 39 and the contact projection 40 are formed by press molding with respect to the back face of the nozzle plate 10, by forming the concave section 39 on the back face of the nozzle plate 10 through press molding, the nozzle formation face 30 may be swollen, thereby forming the contact projection 40. Therefore, the contact projection 40 can be easily formed, manufacturing costs can be prevented from being unnecessarily increased, and position accuracy when the contact projection 40 is formed can be improved. As a result, reliability can be ensured.

Further, the contact projection 40 is formed in the region along the end side of the nozzle plate 10, and thus the electrical connection to with the head cover 27 can be ensured in the region along the end side of the nozzle plate 10. Therefore, an effective area of the nozzle formation face 30 to be exposed from the window 31 of the head cover 27 is not made narrower than is necessary, such that the head itself can be prevented from being enlarged.

Further, since the plurality of contact projections 40 are formed along the end side of the nozzle plate 10, the electrical connection with the head cover 27 can be ensured by just one of the plurality of contact projections 40. Therefore, a possibility of occurrence of troubles due to connection defects can be significantly reduced, such that reliability can be ensured.

Further, the head cover 27 includes the cover section 32 which covers the nozzle formation face 30, the side face sections 33 which are bent from the cover section 32 so as to cover the side faces of the head case 16, and the screwing sections 34 which are bent from the side face sections 33 so as to screw the head cover 27. When the head cover 27 is screwed to cover the nozzle formation face 30 and the head case 16, the contact projection 40 and the head cover 27 is electrically connected to each other. Therefore, by screwing the head cover 27, the force is applied in a direction in which the cover section 32 of the head cover 27 is pressed onto the nozzle formation face 30. As a result, a force is easily applied in a direction in which the cover section 32 is pressed onto the contact projection 40, such that the connection can be reliably ensured and reliability can be improved.

Further, the contact projection 40 is formed in the region close to the screwing section 34 of the head cover 27 in the nozzle formation face 30 of the nozzle plate 10. Accordingly, by forming the contact projection 40 in the region close to the screwing section 34, the force can be easily applied in the direction in which the cover section 32 is pressed onto the contact projection 40, such that the connection can be ensured reliably and reliability can be improved.

Further, the contact projection 40 is formed in the region where the cover section 32 is pressed onto the nozzle formation face 30 through the side face sections 33 by the tightening torque when the head cover 27 is screwed. Therefore, the contact projection 40 is formed in the region where the force is applied in the direction in which the cover section 32 of the head cover 27 is pressed onto the nozzle formation face 30, by screwing the head cover 27. As a result, the connection can be ensured reliably and reliability can be improved.

Further, when the plurality of nozzle plates 10 are cut out from the base material plate 41, the contact projections 40 are formed in the proposed regions 42*a*, 42*b*, and 42*c* by at least the number of digits in the binary number when the binary number represents the number of nozzle plates 10 to be cut out from the base material plate 41. Therefore, in order to analyze defects of the plurality of the nozzle plates 10 cut out from the base material plate 41, the contact projections 40 can be used for marking the arrangement addresses of the nozzle plates 10 in the base material plate 41. Further, a process of forming only the contact projections 40 does not need to be provided, and thus it is very advantageous in view of process efficiency or costs.

Further, according to whether or not the contact projection 40 is formed in each of the proposed regions 42*a*, 42*b*, and 42*c*, the arrangement address of the nozzle plate 10 in the base material plate 41 is displayed. Therefore, when the contact projection 40 is used for marking the arrangement address of the nozzle plate 10 in the base material late 41, a process of forming only the contact projection 40 does not need to be provided, and thus it is very advantageous in view of process efficiency or costs.

Further, the insulating film 37 is a water repellent film, and thus a glassy or ceramic film having an excellent water repellent effect can be applied. Therefore, cleanliness of the nozzle formation face after wiping can be improved, and dirt or ejecting defects on an object surface caused by dirt of the nozzle formation face can be safely reduced.

Further, the conductive mother material 36 of the nozzle plate 10 is grounded through the head cover 27. Therefore, the static electricity transferred from the paper to the nozzle plate 10 or the charges of the nozzle plate 10 can be effectively released through the head cover 27. As a result, ejecting defects or the damage of the IC caused by dirt on the nozzle formation face 30 can be effectively prevented.

Figure 20:
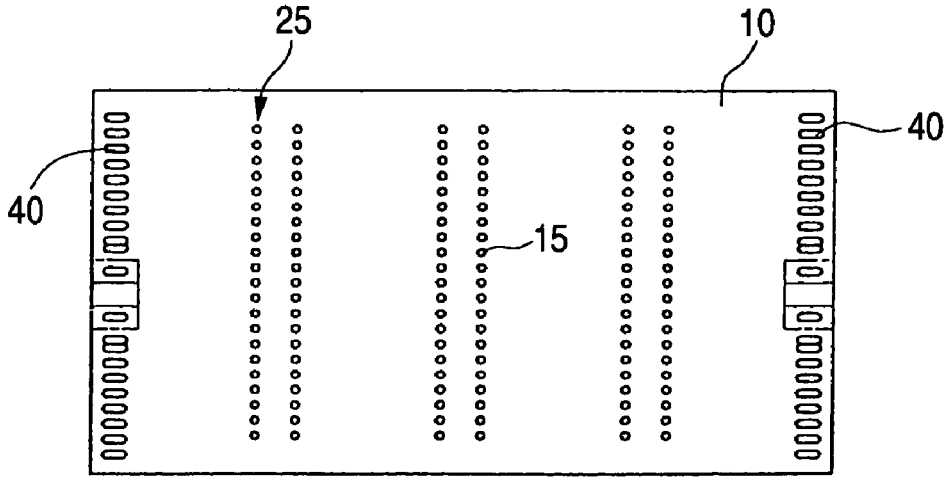
FIG. 20 is a plan view of a nozzle plate in an ink jet recording head according to a third embodiment of the invention.

FIG. 20 shows a third embodiment of the invention. Components similar to those in the second embodiment will be designated by the same reference numerals and repetitive explanations for those will be omitted. In this embodiment, arrays of the contact projections 40 are formed in regions close to both edges of the nozzle plate 10 in the primary scanning direction.

In this embodiment, the exposure section 38 is not formed in the above-described method in which the insulating film 37 is peeled off by the friction between the contact projection 40 and the head cover 27 when the head cover 27 is mounted. Alternatively, the insulating film 37 in the top region of the contact projection 40 is removed by grinding the nozzle formation face 30 of the nozzle plate 10, thereby forming the exposure section 38.

That is, the exposure section 38 may be formed by grinding the nozzle formation face of the nozzle plate 10 so as to remove the insulating film 37 in the top region of the contact projection 40 in a state of the flow passage unit 26 into which the nozzle plate 10 having the top portion of the contact projection 40 covered with the insulating film 37 is assembled or by grinding the nozzle formation face of the nozzle plate 10 so as to remove the insulating film 37 in the top region of the contact projection 40 in a state of the head body 2 in which the flow passage unit 26 is fixed to the head case 16.

In this case, the contact projections 40 are arranged in the regions close to both edges in the primary scanning direction of the nozzle plate 10, such that the posture of the flow passage unit 26 or the head body 2 during grinding is stabilized and a damage of the nozzle formation face 30 at the time of grinding is prevented. As to any other points, the same advantages as those in the second embodiment can be obtained.

Next, a fourth embodiment of the invention will be described. Similar components to those in the second embodiment will be designated by the same reference numerals and repetitive explanations for those will be omitted.

Figure 21A:
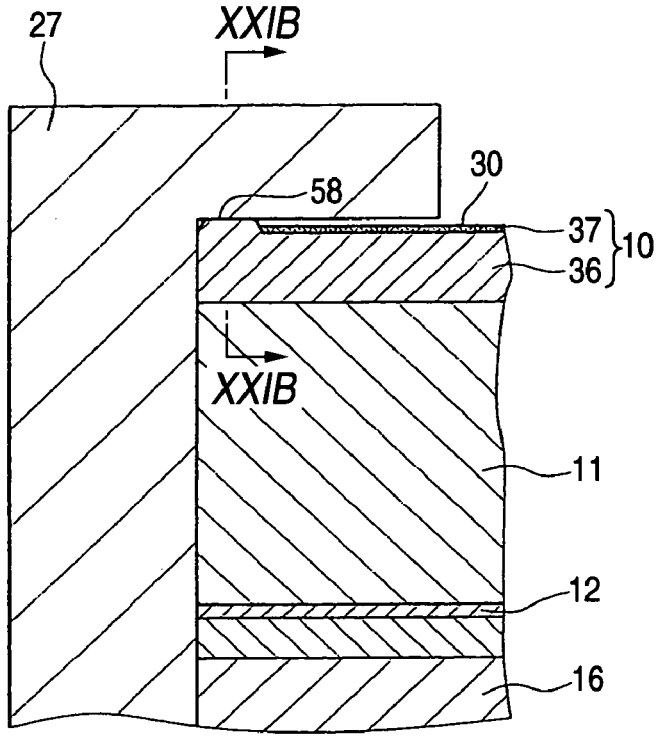
FIG. 21A is an enlarged section view showing a state that a head cover and a nozzle plate are electrically connected via contact projections in an ink jet recording head according to a fourth embodiment.
Figure 21B:
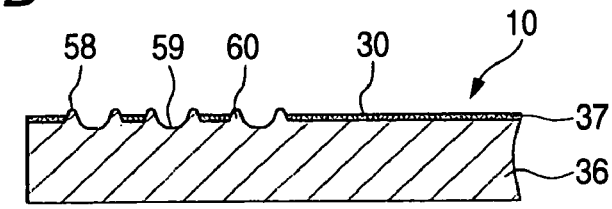
FIG. 21B is an enlarged section view of the nozzle plate of FIG. 21A.
Figure 21C:
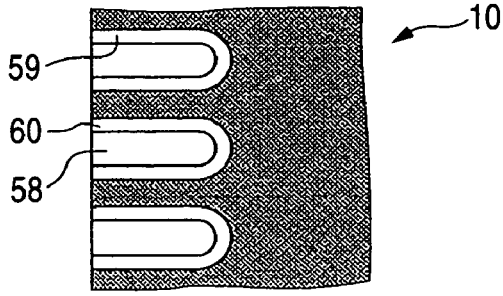
FIG. 21C is an enlarged top plan view of the nozzle plate of FIG. 21A.

In this embodiment, an exposure section 58 shown in FIG. 21A is formed as follows. By performing laser marking with respect to the nozzle formation face 30 of the nozzle plate 10, as shown in FIGS. 21B and 21C, a concave section 59 is formed on the nozzle formation face 30 of the conductive mother material 36, and the peripheral portion of the concave section 59 is swollen by heat or stress generated at the time of laser marking. And then, a contact projection 60, in which the conductive mother material 36 projects on the nozzle formation face 30 of the nozzle plate 10, is formed to be swollen, and the top region of the contact projection 60 is formed in the exposure section 58.

The contact projection 60 of the conductive mother material 36 is set to have a projection height larger than the thickness of the insulating film 37, and thus the top region of the contact projection 60 projects from the surface of the insulating film 37 on the nozzle formation face 30, such that the conductive mother material 36 is exposed to the nozzle formation face 30. That is, the thickness of the insulating film 37 is set in a range of bout 0.1 to 1 μm. In contrast, the projection height of the contact projection 60 from the nozzle formation face 30 of the conductive mother material 36 is set in a range of about 3 to 6 μm. If the concave section 59 and the projection section 60 have the same mother material quality, the projection height of the contact projection 60 is changed according to the laser intensity at the time of laser marking. Therefore, control and management can be performed by adjusting the laser intensity.

Figure 22:
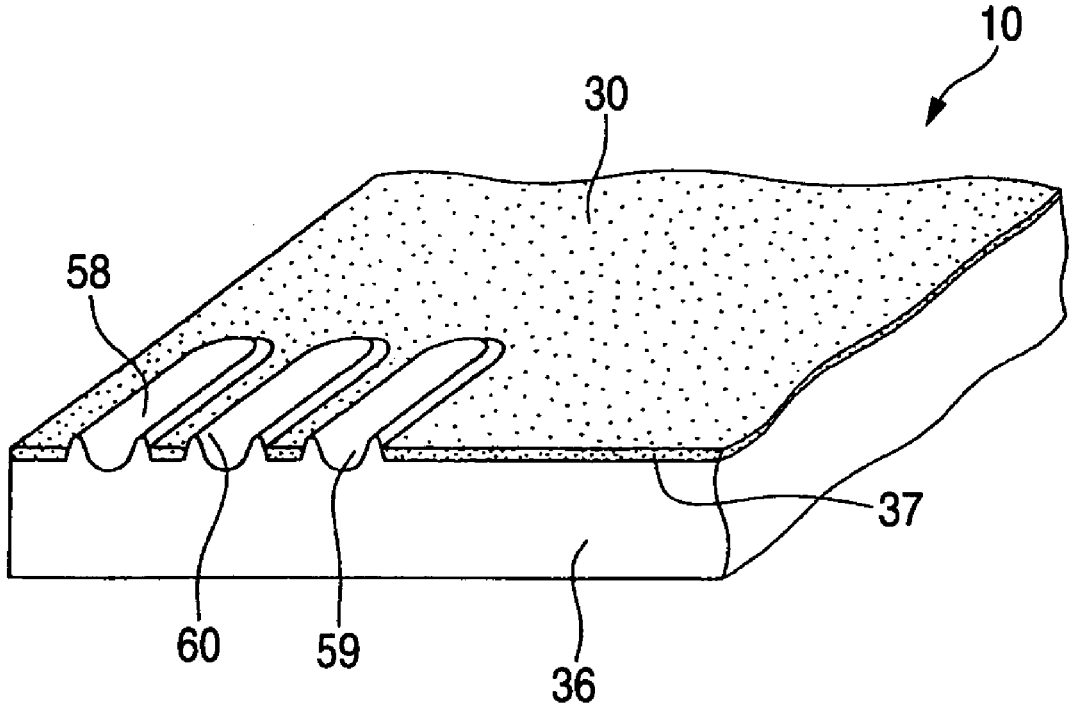
FIG. 22 is an enlarged perspective view of the nozzle plate of FIG. 21A.

As shown in FIGS. 21C and 22, the contact projection 60 is formed on the nozzle formation face 30 in the vicinity of the edge of the nozzle plate 10. The groove-shaped concave section 59 formed by laser marking opens in the end portion of the nozzle plate 10, and the substantially U-shaped contact projection 60 is formed around the concave section 59.

Figure 23A:
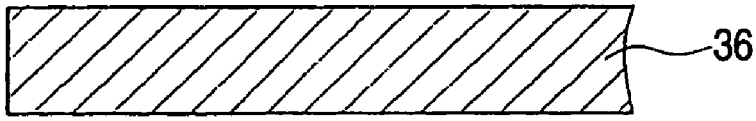
FIGS. 23A to 23C are section views for explaining how to make the nozzle plate of FIG. 21A.
Figure 23B:
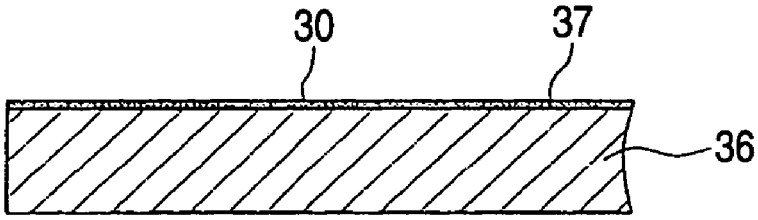

Specifically, as shown in FIGS. 23A and 23B, the insulating film 37 is formed on the nozzle formation face 30 of the base material plate 41 in which the nozzle orifices 15 are formed.

Figure 23C:
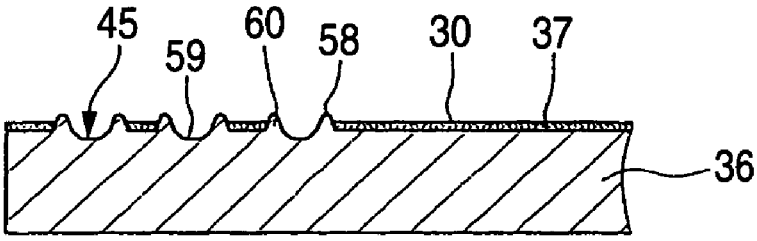

Next, as shown in FIG. 23C, laser marking is performed on the nozzle formation face 30 of the base material plate 41 on which the insulating film 37 is formed, thereby forming laser marks 45. At this time, laser marking is performed so as to form the laser mark 45 in a direction perpendicular to the nozzle arrays 25, crossing the die-cutting proposed line 34, in one end side parallel to the nozzle arrays 25 on one side of both ends in the primary scanning direction of a region, which becomes the nozzle plate 10.

The laser marks 45 are made by forming the concave section 59 in the nozzle formation face 30 of the conductive mother material 36. The peripheral portion of the concave section 59 is swollen by heat or stress generated at the time of laser marking, and thus the contact projection 60, in which the conductive mother material 36 projects on the nozzle formation face 30 of the nozzle plate 10, is formed to be swollen, such that the exposure section 58 is formed in the top region of the contact projection 60.

As described above, the start point mark 44*a* and the end point mark 44*b* are formed in each nozzle plate 10 by laser marking, and the laser marks 45 are formed at constant pitches outside the start point mark 44*a* and the end point mark 44*b*.

As described above, the arrangement address of each nozzle plate is marked and displayed, according to whether or not the laser mark 45 is formed in each of the plurality (three in this embodiment) of proposed regions 42*a*, 42*b*, and 42*c* which are provided between the start point mark 44*a* and the end point mark 44*b*.

The outline of the nozzle plate 10 is formed by punching the punching proposed line 43, and thus the nozzle plate 10 is formed. At this time, punching is performed such that the laser mark 45 is laterally cut, and thus the contact projection 60 is formed from the nozzle formation face 30 of the nozzle plate 10 up to the edge. The contact projection 60 has a substantially U shape.

With the above configurations, the concave section 59 is formed on the nozzle formation face 30 of the nozzle plate 10 by laser marking, and the peripheral portion of the concave section 59 is swollen, thereby forming the contact projection 60. Therefore, the contact projection 60 can be easily formed, manufacturing costs can be prevented from being unnecessarily increased, and position accuracy when the contact projection 60 is formed can be also improved. As a result, reliability can be ensured. As to any other points, the same advantages as those in the second embodiment can be obtained.

In this embodiment, arrays of the contact projections 40 may formed in regions close to both edges of the nozzle plate 10 in the primary scanning direction, as in the third embodiment.

In the above embodiments, the insulating film 37 is a water repellent film. However, various types of insulating films 37, such as a hydrophobic film or the like, may be applied, as long as the film has characteristics suitable for the nozzle formation face 30 of the nozzle plate 10.

In the above embodiments, a plurality of nozzle plates 10 are cut out from the base material plate 41 by pressing. However, various methods, other than pressing, such as laser cutting and the like, may be used.

In the above embodiments, the piezoelectric vibrator 14 is used as the pressure generating element. However, a Bubble Jet (Registered Trademark) type ink jet recording head in which liquid within a pressure generating chamber is heated to generate bubbles may be used.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A liquid ejection head, comprising:

a conductive nozzle plate, formed with a nozzle orifice;

an insulative layer, formed on a first face of the nozzle plate;

a head body, including a pressure chamber adapted to contain liquid therein and a pressure generating element operable to cause pressure fluctuation in the liquid, the head body attached to a second face of the nozzle plate so as to communicate the pressure chamber with the nozzle orifice;

a head case, to which the second face of the nozzle plate and the head body are fixed;

a conductive head cover, covering a part of the first face of the nozzle plate while exposing the nozzle orifice, wherein a part of the nozzle plate and the head cover directly come into contact with each other, and a projection is formed on the head cover so as to come in contact with the nozzle plate through the insulative layer.

2. The liquid ejecting head as set forth in claim 1, wherein:

the head cover includes a frame portion covering the part of the first face of the nozzle plate and a window portion exposing the nozzle orifice; and the projection is formed on an inner peripheral edge of the window portion.

3. The liquid ejecting head as set forth in claim 1, wherein:

the head cover includes a through hole adapted to receive a pin member for fixing the head cover to the head case; and the projection is formed on an inner peripheral edge of the through hole.

4. The liquid ejecting head as set forth in claim 1, wherein the insulative layer includes a liquid repellent coating.

5. The liquid ejecting head as set forth in claim 1, wherein the nozzle plate is grounded via the head cover.

6. A liquid ejection head, comprising:

a conductive nozzle plate, formed with a nozzle orifice;

an insulative layer, formed on a first face of the nozzle plate;

a head body, including a pressure chamber adapted to contain liquid therein and a pressure generating element operable to cause pressure fluctuation in the liquid, the head body attached to a second face of the nozzle plate so as to communicate the pressure chamber with the nozzle orifice;

a head case, to which the second face of the nozzle plate and the head body are fixed;

a conductive head cover, covering a part of the first face of the nozzle plate while exposing the nozzle orifice, wherein a part of the nozzle plate and the head cover directly come into contact with each other, and wherein:

a projection is formed on the first face of the nozzle plate; and the insulative layer is removed from a top face of the projection so that the top face of the projection comes in contact with the head cover.

7. The liquid ejecting head as set forth in claim 6, wherein a height dimension of the projection is greater than a thickness dimension of the insulative layer.

8. The liquid ejecting head as set forth in claim 6, wherein a recess is formed on the second face of the nozzle plate so as to oppose the projection.

9. The liquid ejecting head as set forth in claim 6, wherein a recess is formed on the first face of the nozzle plate, and the projection is formed around the recess.

10. The liquid ejecting head as set forth in claim 6, wherein the projection is formed in the vicinity of an edge of the nozzle plate.

11. The liquid ejecting head as set forth in claim 6, wherein:

the head cover includes a fixing portion adapted to receive a screw member for fixing the head cover to the head case; and the projection is formed in the vicinity of the fixing portion.

12. The liquid ejecting head as set forth in claim 6, wherein:

the head cover includes a fixing portion adapted to receive a screw member for fixing the head cover to the head case; and the projection is formed in a region receiving a torque generated when the screw member is screwed.

13. The liquid ejecting head as set forth in claim 6, wherein a position of the projection indicates a position in a mother conductive plate from which the nozzle plate is cut out.

14. The liquid ejecting head as set forth in claim 6, wherein the insulative layer includes a liquid repellent coating.

15. The liquid ejecting head as set forth in claim 6, wherein the nozzle plate is grounded via the head cover.

* * * * *